US006132022A

United States Patent [19]

Akiyama et al.

[11] Patent Number: 6,132,022

[45] **Date of Patent: *Oct. 17, 2000**

[54] INK JET RECORDING APPARATUS AND METHOD IN WHICH PROCESSING IS CONTROLLED ACCORDING TO A PROPERTY OF AN EXCHANGEABLY RECORDING MEMBER

[75] Inventors: Yuji Akiyama; Hiromitsu Hirabayashi, both of Yokohama; Toshio Kashino, Chigasaki; Hitoshi Sugimoto, Yokohama; Miyuki Matsubara, Tokyo; Fumihiro Gotoh, Kawasaki; Hidehiko Kanda, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,061

[22] Filed: Jul. 14, 1997

Related U.S. Application Data

[63] Continuation of application No. 08/246,753, May 20, 1994, abandoned.

[30] Foreign Application Priority Data

May 26, 1993 [JP] Japan ..... 5-124192

[51] Int. Cl.[7] ..... B41J 2/205

[52] U.S. Cl. ..... 347/15; 347/19

[58] Field of Search ..... 347/14, 15, 19, 347/43, 49; 358/298

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitana et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,860,026 | 8/1989 | Matsumoto et al. | 347/15 |
| 4,872,027 | 10/1989 | Budkirk et al. | 347/19 |
| 4,952,942 | 8/1990 | Kanome et al. | 346/1.1 |
| 5,049,898 | 9/1991 | Arthur et al. | 347/19 |
| 5,075,698 | 12/1991 | Aoki et al. | 347/15 |
| 5,142,374 | 8/1992 | Tajiki et al. | 358/298 |
| 5,610,637 | 3/1997 | Sekiya et al. | 347/10 |

FOREIGN PATENT DOCUMENTS

| | | |
|---|---|---|
| 0374762 | 6/1990 | European Pat. Off. . |
| 1-235655 | 9/1989 | Japan . |
| 3-5156 | 1/1991 | Japan . |
| 4-255361 | 9/1992 | Japan . |
| 5-31906 | 2/1993 | Japan . |
| 5-31918 | 2/1993 | Japan . |
| 5-64890 | 3/1993 | Japan . |

*Primary Examiner*—N. Le
*Assistant Examiner*—Craig A. Hallacher
*Attorney, Agent, or Firm*—Fitzpatrick, Cella, Harper & Scinto

[57] ABSTRACT

The present invention aims to provide an ink jet recording apparatus and an ink jet recording method which can produce an image excellent in gradation and resolution and allows the image for text, graphics and listing to the obtained at high speed and good quality. The present invention allows a desired recorded image to be obtained by exchangeably comprising an ink jet unit for producing the image excellent in gradation, and an ink jet unit having higher character quality and capable of recording at high speed, and effecting recording control in accordance with the ink jet unit.

36 Claims, 22 Drawing Sheets

INK JET RECORDING APPARATUS AND METHOD IN WHICH PROCESSING IS CONTROLLED ACCORDING TO A PROPERTY OF AN EXCHANGEABLY RECORDING MEMBER

This application is a continuation of application Ser. No. 08/246,753 filed May 20, 1994, now abandoned.

BACKGROUND OF THE INVENTION

1. Field of the Invention

The present invention relates to an ink jet recording apparatus and an ink jet recording method capable of recording the half-tone image in such a manner as to change the number of recording dots per unit area, as well as recorded matters.

2. Related Background Art

In the conventional ink jet recording methods, the recording is performed in such a manner as to discharge the ink through a plurality of discharge orifices formed in a recording head in accordance with data signal and attach ink droplets onto the recording medium such as a paper. This recording method has been utilized for printers, facsimile apparatuses, or copying machines, for example.

For the above apparatuses, there is a method involving the use of electricity-heat energy converters in which heat generating elements (electrothermal energy converters or electricity-heat energy converters) are provided in the neighborhood of discharge orifices to discharge the ink and apply an electrical signal to those heat generating elements to heat the ink locally, thus causing a pressure change therein to discharge the ink through discharge orifices, or the use of electromechanical converters such as piezo-electrical elements.

In this type of recording method, the half-tone recording is controlled in accordance with a dot density control method in which the half-tone is represented by controlling the number of recording dots per unit area with the recording dot of fixed size, or a dot diameter control method in which the half-tone is represented by controlling the size of recording dots.

Herein, the latter dot diameter control method has some restrictions because of its complex control required to minutely change the size of recording dot, and therefore the former dot density control method is generally employed.

When the electricity-heat energy converters are used as ink discharge means, they can be easily manufactured and allows for the high density, and thus the high resolution, but has the difficulty in controlling the amount of pressure change, so that the diameter of recording dot can not be readily modulated. Hence, the dot density control method is mainly employed for the half-tone recording with the ink jet recording method.

Typical of the binarization method for the half-tone representation for use with this dot density control method is an organizational dither method, but this method has a problem that the number of gradations is limited by the matrix size. That is, to increase the number of gradations requires to increase the matrix size, but there is a problem that if the matrix size is increased, one pixel of recording image which is constituted of one matrix is larger, thereby resulting in lower resolution. Also another typical binarization method is a conditioned decision type dither method such as an error diffusion method. This is a method in which the threshold is changed in consideration of peripheral pixels around the input pixel, whereas the above-mentioned organizational dither method is an independent decision type dither method in which the binarization is made using a threshold value irrespective of the input pixel. The conditioned decision type dither method represented by this error diffusion method has the advantage that there is good compatibility between gradation and resolution, and that when the original image is a printed image, there are quite less moire patterns produced in the recorded image, whereas it has the drawback that the graininess becomes conspicuous in the light part of image, degrading the evaluation of image quality. This problem was remarkable particularly in the recording apparatus having low recording density.

To make the above graininess inconspicuous, a recording method has been proposed in which two recording heads for discharging the inks which are thin and thick in the dye concentration respectively are provided for the recording. With this method, the portion from the light part of image to the half-tone part has recording dots formed by the thin ink in the dye concentration, while the portion from the half-tone part to the dark part has recording dots formed by the thick ink. The dots formed by the thin ink in the dye concentration are light in the image density, while the dots by the dark ink in the dye concentration is dark in the image density.

FIG. 23 is a constitutional view showing the essence of a conventional color ink jet recording apparatus of the serial print type employing the dark/light ink.

Kk is a recording head for discharging a color ink of dark black, Ku is a recording head for discharging a color ink of light black, Ck is a recording head for discharging a color ink of dark cyan, Cu is a recording head for discharging a color ink of light cyan, Mk is a recording head for discharging a color ink of dark magenta, Mu is a recording head for discharging a color ink of light magenta, Yk is a recording head for discharging a color ink of dark yellow, and Yu is a recording head for discharging a color ink of light yellow. Each of the recording heads is installed a predetermined distance apart on a carriage 241.

The ink is supplied to each recording head from an ink cartridge 248 corresponding to respective color. Also, the control signal to recording head is provided via a flexible cable 249.

A recording medium composed of paper or plastic thin plate is passed by a conveying roller (not shown) and carried therewith by paper exhausting rollers 242 to be fed in a direction of the arrow by the driving of a conveying motor not shown.

Carriage 241 is guided and supported by means of a guide shaft 243, and an encoder not shown.

Carriage 241 is caused to reciprocate along the guide shaft 243 by the driving of a carriage motor 245 via a drive belt 244.

The inside of an ink discharge orifice of the recording head or a liquid channel through which the ink flows is provided with a heat generating element (electricity-heat energy converter) for generating the heat energy for use in discharging the ink.

In accordance with the read timing of encoder, the above-mentioned heat generating elements are driven on the basis of a recording signal to discharge ink droplets onto the recording medium in the order of dark black, light black, dark cyan, light cyan, dark magenta, light magenta, dark yellow, and light yellow, thereby forming an image.

At a home position of carriage selected out of the recording area, a recovery unit 246 having a cap portion 247 is disposed to effect the recovery of ink discharge performance and maintain the stability of ink discharge.

In the case of a so-called pictorial image in which the output image is represented in gradation, the reproduction of image with reduced graininess can be effected by making the effective use of the dark/light ink.

On the other hand, it is often preferred to perform the recording only by the use of dark ink, in the case of an image not requiring any gradation representation such as a document, graphics or listing which is composed of characters and line drawing, or an image already expanded in binary form by the computer.

For the purposes of achieving the compactness and the low price of the apparatus, and performing the recording by using the dark/light ink, a method is provided in which a recording head is used having a plurality of discharge orifice arrays for discharging different inks onto the same discharge orifice formation face of the same recording head. In this case, there is a problem that though the apparatus is smaller, the array of discharge orifices is divided corresponding to used ink color and the number of discharge orifices for each ink color is reduced, whereby the recording width per scan is narrower and the recording speed is decreased. Accordingly, the apparatus with its principal usage found only on the recording by the use of such dark/light ink is unsuitable for the output of document, graphic and listing image.

SUMMARY OF THE INVENTION

An object of the present invention is to resolve the aforementioned problems, and provide a compact ink jet recording apparatus and an ink jet recording method which is capable of producing an image excellent in gradation and resolution with reduced graininess, and producing the image for document, graphic and listing at high speed and good quality, as well as recorded products obtained by carrying out said ink jet recording method.

To accomplish the above object, the present invention provides an ink jet recording apparatus which can perform the recording by discharging the ink onto the recording medium in accordance with the recording data, characterized by comprising a mounting portion for exchangeably mounting either first recording means for discharging a single kind of ink or second recording means capable of discharging a plurality of kinds of inks, discriminating means for discriminating whether recording means to be mounted on said mounting portion is said first recording means or said second recording means, and recording control changing means for changing the recording control in accordance with said discriminating means.

Also, the present invention provides an ink jet recording apparatus which can perform the recording by discharging the ink onto the recording medium in accordance with the recording data, characterized by comprising a mounting portion for exchangeably mounting either first recording means for discharging a single kind of ink or second recording means capable of discharging a plurality of kinds of inks, information generating means for generating information as to whether recording means to be mounted on said mounting portion is said first recording means or said second recording means, and recording control changing means for changing the recording control in accordance with the information of said information generating means.

Also, the present invention provides an ink jet recording method which can perform the recording by discharging the ink onto the recording medium in accordance with the recording data, by using recording means mounted on a mounting portion for exchangeably mounting either first recording means for discharging a single kind of ink or second recording means capable of discharging a plurality of kinds of inks, characterized by including a discrimination step of discriminating whether recording means to be mounted on said mounting portion is said first recording means or said second recording means, and a recording control changing step of changing the recording control in accordance with said discrimination step.

Also, the present invention provides an ink jet recording method which can perform the recording by discharging the ink onto the recording medium in accordance with the recording data, by using recording means mounted on a mounting portion for exchangeably mounting either first recording means for discharging a single kind of ink or second recording means capable of discharging a plurality of kinds of inks, characterized by including an information generation step of generating information as to whether recording means to be mounted on said mounting portion is said first recording means or said second recording means, and a recording control changing step of changing the recording control in accordance with the information of said information generation step.

DETAILED DESCRIPTION OF THE PREFERRED EMBODIMENTS

The preferred embodiments of an ink jet recording apparatus of the present invention will be described below in detail with reference to the drawings.

[First embodiment]

(Configuration of recording apparatus)

Figure 1:
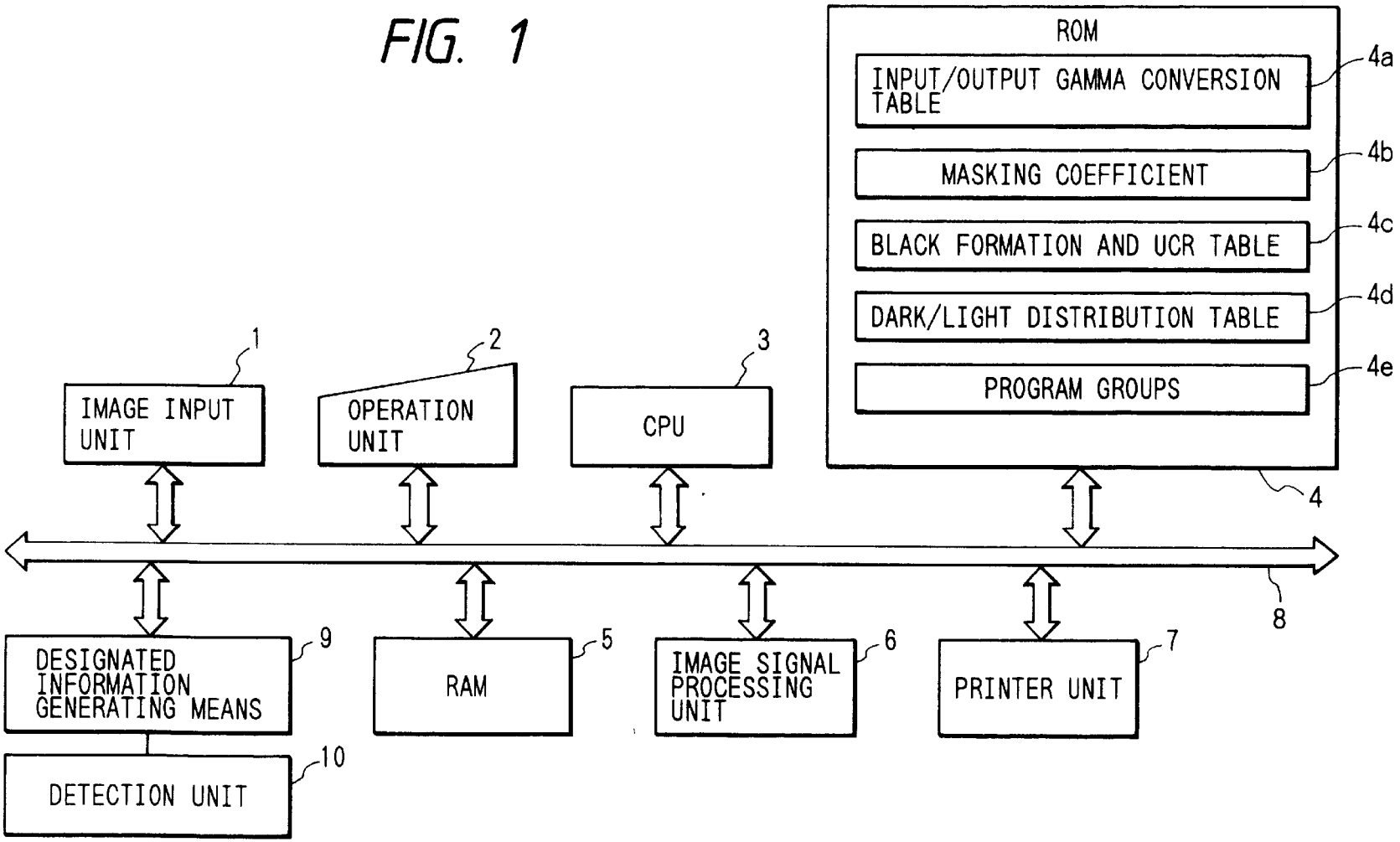
FIG. 1 is a block diagram showing the configuration of a color ink jet recording apparatus in accordance with an embodiment of the present invention.

FIG. 1 is a block diagram showing the configuration of a color ink jet recording apparatus in accordance with this embodiment.

In the figure, 1 is an image input unit for optically reading an original image by a CCD, or inputting an image luminance signal (RGB) from a host computer or a video equipment, and 2 is an operation unit having a variety of keys for setting various parameters and instructing the print start. 3 is a CPU for controlling the whole of this recording apparatus in accordance with various programs stored in a ROM, this CPU constituting discriminating means and image formation condition setting means in the present invention. 4 is a ROM for storing programs for operating this recording apparatus in accordance with a control program error processing program, and image formation conditions. In this ROM, 4*a* is an input/output gamma conversion table to be referred to in the processing of an input/output gamma conversion circuit, 4*b* is a masking coefficient to be referred to in the processing of a color correction (masking) circuit, 4*c* is a black formation and UCR table to be referred to in the processing of a black formation and UCR circuit, 4*d* is a dark/light distribution table to be referred to in the processing of a dark/light distribution circuit, 4*e* is a program group in which various programs for performing the above-described processings are stored. The processing in each circuit will be described later in detail. 5 is a RAM useful for the work area for various programs in the ROM and the temporary save area at the error handling. 6 is an image signal processing unit as will be described later and 7 is a printer unit for forming the dot image based on the image signal processed by the image signal processing unit at the recording. 8 is a bus line for transmitting an address signal, data and a control signal within the apparatus. 9 is designated information generating means for any one of a host computer connecting to the recording apparatus, a dip switch provided on the recording apparatus, an operation panel for the recording apparatus, memory means provided on the recording apparatus, and ink discharging means or an ink cartridge mounted on the recording apparatus, and 10 is a detection unit for detecting the type of ink jet unit. The designated information from the designated information generating means 9 is designated command information from the host computer, dip switch information from the dip switch, panel information from the operation panel, memory information from the memory means, or a designated signal from the ink discharging means or ink cartridge.

(Image signal processing unit)

An image signal processing unit will be now described.

Figure 2:
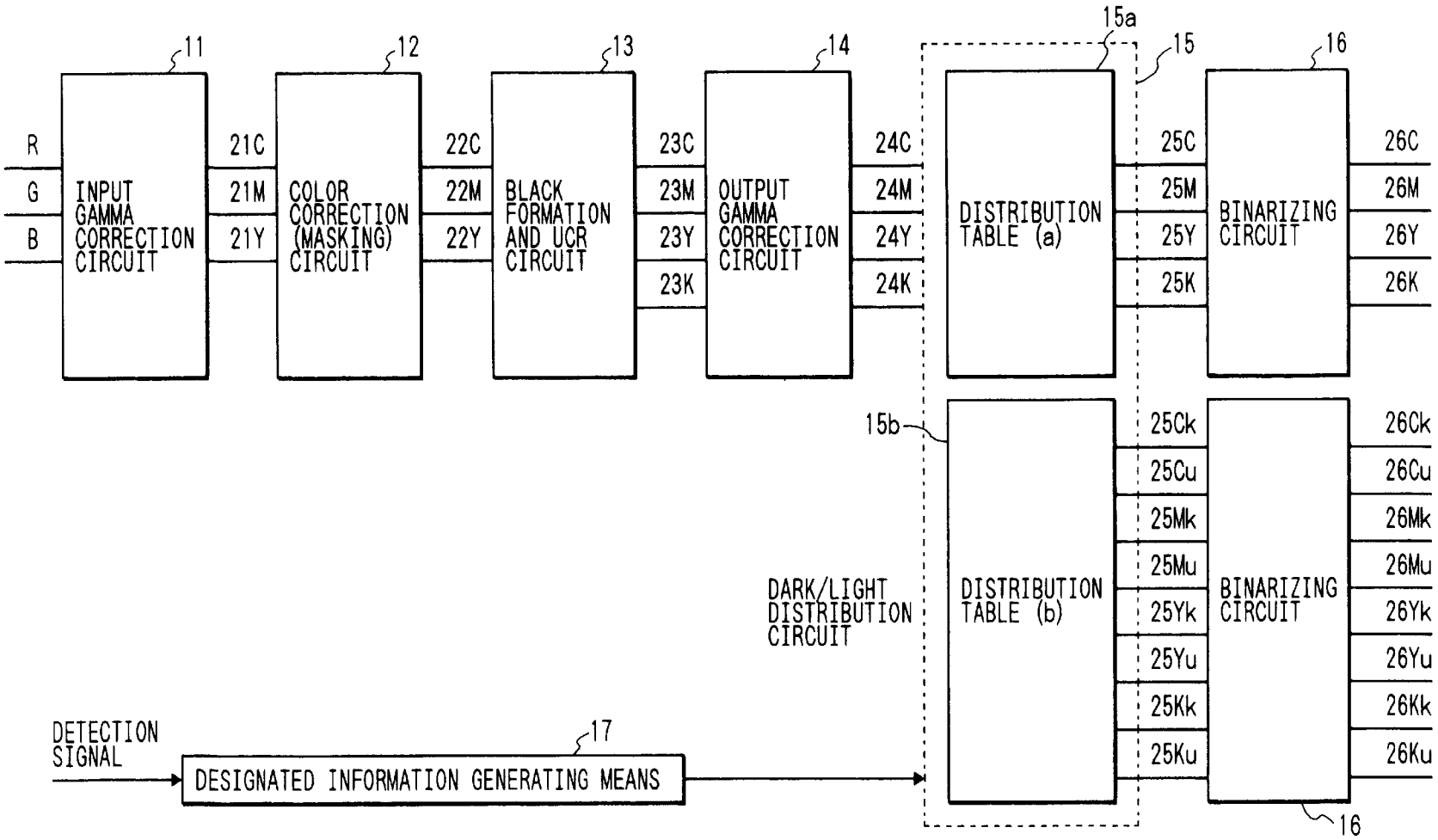
FIG. 2 is a diagram exemplifying an image signal processing circuit in the color ink jet recording apparatus in accordance with the embodiment of the present invention.

FIG. 2 shows an example of an image signal processing circuit in a color ink jet recording apparatus in this embodiment.

Red image luminance signal R, green image luminance signal G, and blue image luminance signal B are converted into a cyan image density signal 21C, a magenta image density signal 21M and a yellow image density signal 21Y in an input gamma correction circuit 1.

Further, after the color processing in a color correction (masking) circuit 12 and a black formation and UCR (Under Color Removal) circuit 13, they are converted into the new image density signals 23C, 23M, 23Y and 23K of cyan, magenta, yellow and black. Then, they are converted into image density signals 24C, 24M, 24Y and 24K of cyan, magenta, yellow and black by undergoing gamma correction in an output gamma correction circuit 14.

Figure 3A:
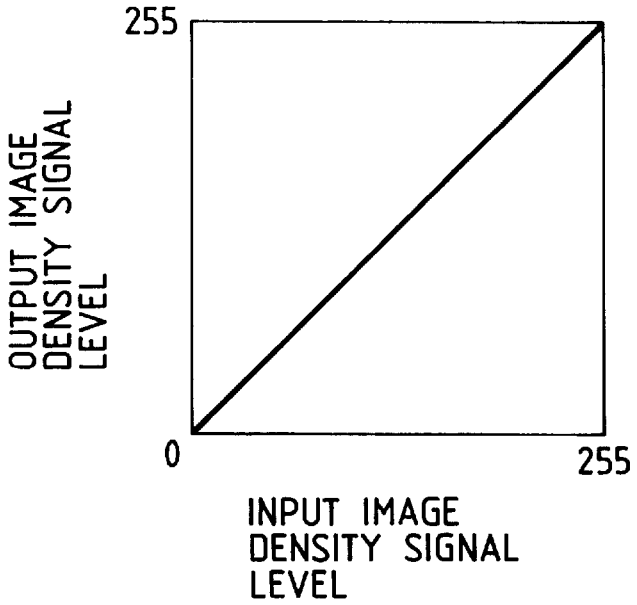
FIGS. 3A and 3B are explanation views of a dark/light distribution table.
Figure 3B:
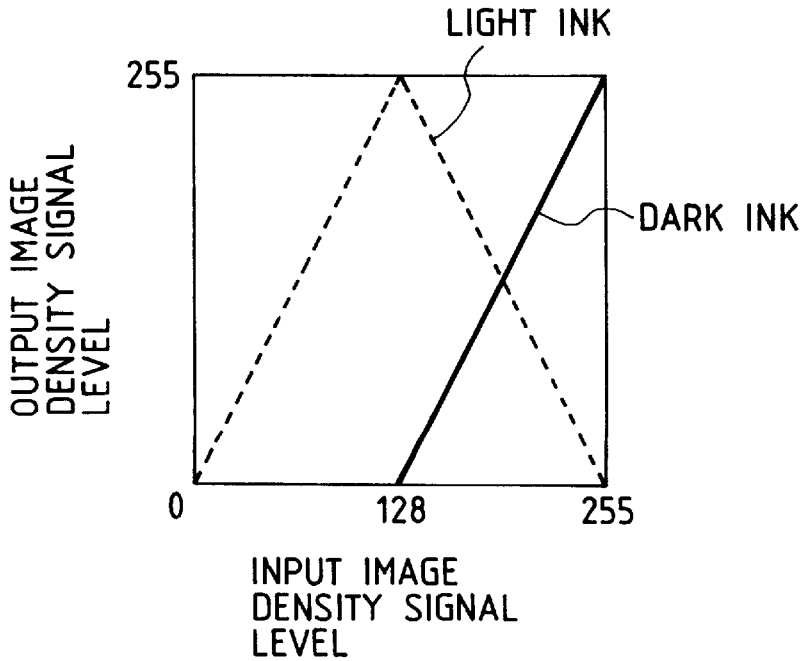

FIGS. 3A and 3B are diagrams for exemplifying a dark/light distribution table to be used in a dark/light distribution circuit 15 in accordance with a designated signal. A conversion table of FIG. 3A is selected when the monochrome ink is only used, while that of FIG. 3B is used when the inks of two different densities are used for the conversion into a dark/light signal in the dark/light distribution circuit 15.

This table has set the image density signal value and the optical reflection density value of image recorded so as to exhibit the proportional linear relation.

A table is selected by the dark/light distribution circuit 15 in accordance with designated information from the designated information generating means 17 which is issued by a designated signal. When the dark/light distribution table 15*a* of FIG. 3A is selected by the dark/light distribution circuit 15, the density signals of cyan, magenta, yellow and black are directly output without distribution into dark and light. When the dark/light distribution table 15*b* of FIG. 3B is selected, they are converted into the image density signals 25Ck, 25Mk, 25Yk and 25Kk of dark cyan, dark magenta, dark yellow and dark black which are at higher dye density, and the image density signals 25Cu, 25Mu, 25Yu and 25Ku of light cyan, light magenta, light yellow and light black which are at lower dye density.

Each image density signal output from the dark/light distribution circuit is binarized by a binarization circuit 16, and a corresponding color ink is discharged in accordance with a signal value from each ink jet unit to effect the formation of image. Binarization circuit 16 is a common circuit, irrespective of whether the recording uses the inks of two different densities or the ink of single density.

Figure 4:
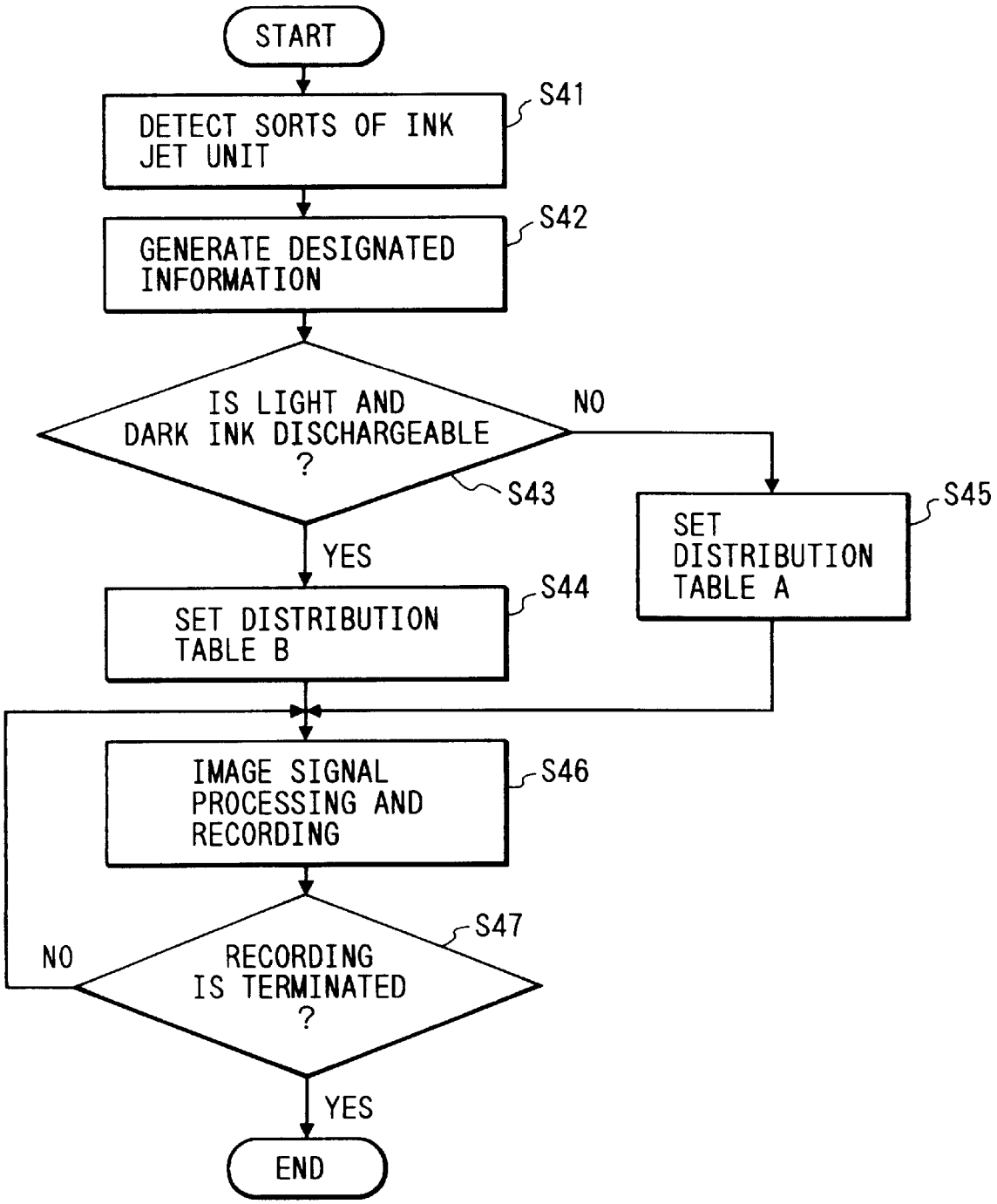
FIG. 4 is a flowchart for selecting the dark/light distribution table.

FIG. 4 is a flowchart when the dark/light distribution table is selected in this embodiment.

At step S41, the sort of ink jet unit is detected by a detection unit, and at step S42, designated information in accordance with a detected result is generated. Next, if the dark/light ink is determined to be dischargeable based on this designated information at step S43, a distribution table B, or a table of FIG. 3B is selected and set in the dark/light distribution circuit 15 at step S44, while if the dark/light ink is determined to be undischargeable at step S43, a dark/light distribution table A, or a table of FIG. 3A is selected and set at step S45.

Because the dark/light distribution table is set prior to recording the image, each processing of input gamma correction, color correction (masking), black formation and UCR, dark/light distribution, and binarization is performed in accordance with the dark/light distribution table set at step S44 or step S45, to complete the recording.

(Printer unit)

Figure 5:
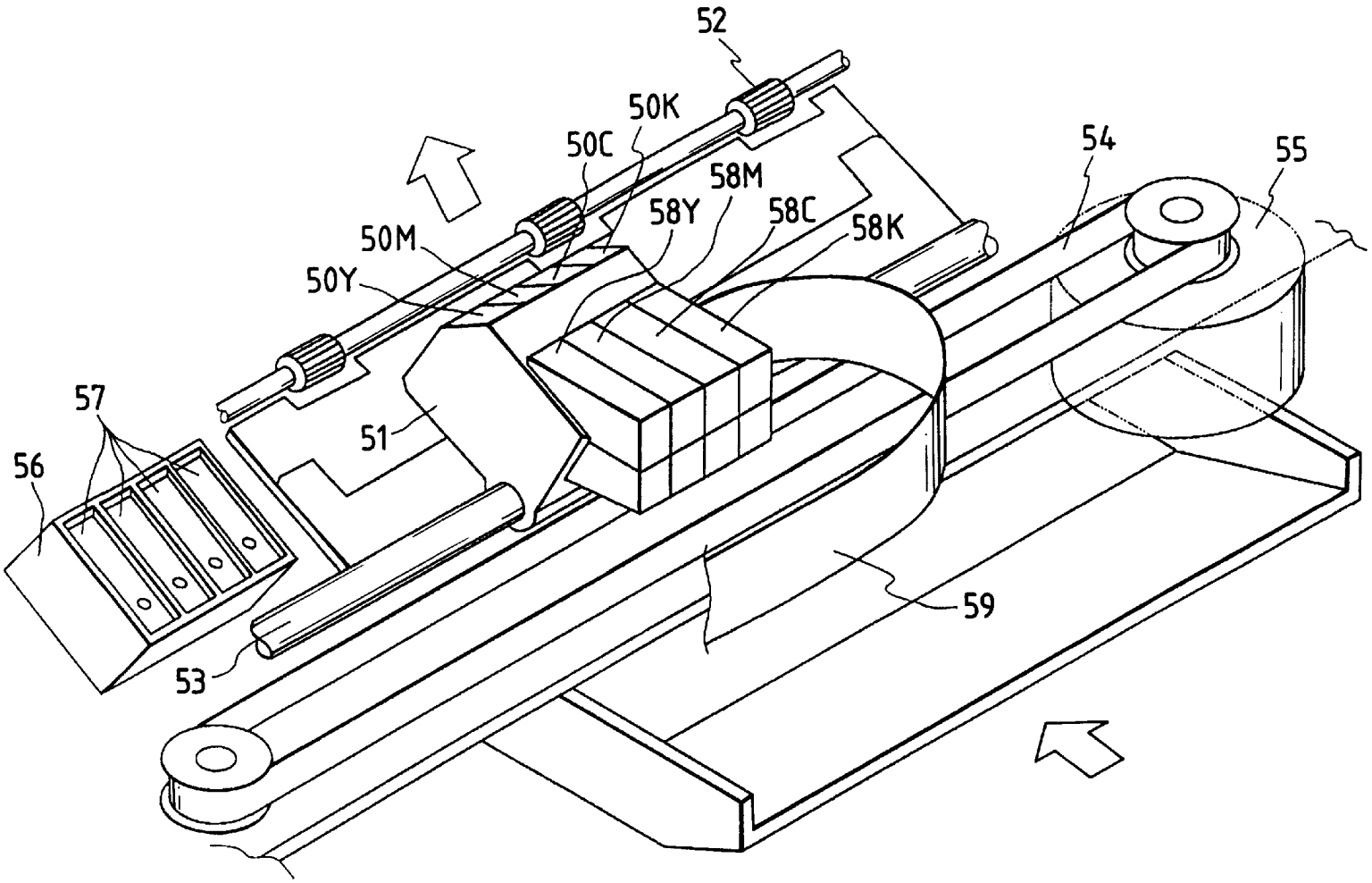
FIG. 5 is a perspective view showing the essence of the color ink jet recording apparatus of the present invention.

FIG. 5 is a perspective view showing the essence of a color ink jet recording apparatus in this embodiment.

In FIG. 5, this apparatus is constituted to effect the image recording using the dark/light ink.

An ink jet unit 50K has integrally a discharge orifice array for discharging the dark black ink and a discharge orifice array for discharging the light black ink. Also, an ink jet unit 50C has integrally a discharge orifice array for discharging the dark cyan ink and a discharge orifice array for discharging the light cyan ink. Also, 50M is an ink jet unit for magenta ink having integrally a discharge orifice array for discharging the dark magenta ink and a discharge orifice array for discharging the light magenta ink, and 50Y is an ink jet unit for yellow ink having integrally a discharge orifice array for discharging the dark yellow ink and a discharge orifice array for discharging the light yellow ink. Each of the ink jet units is installed a predetermined distance apart on the carriage 51.

A corresponding color ink is supplied from an ink cartridge 58 to a corresponding nozzle array for each ink jet unit 50. Each ink cartridge 58 is divided internally into two sections by a partition, two sections containing the dark (thick) ink and the light (thin) ink, respectively.

The ink jet unit 50 and the ink jet cartridge 58 can be exchanged by an ink jet unit corresponding to the ink of single density and an ink cartridge, as required.

The control signal to the ink jet unit 50 is sent via a flexible cable 59.

The recording medium composed of a paper or plastic thin plate is passed by a conveying roller (not shown) and carried by paper exhausting rollers 52 to be fed in a direction of the arrow by the driving of a conveying motor, not shown.

Carraige 51 is supported to be guided by means of a guide shaft 53, and an encoder not shown.

The carriage 51 is caused to reciprocate along the guide shaft 53 by the driving of a carriage motor 55 via a drive belt 54.

The inside (liquid channel) of an ink discharge orifice of each ink jet unit 50 is provided with a heat generating element (electricity-heat energy converter) for generating the heat energy for use in discharging the ink.

In accordance with the read timing of encoder, the above-mentioned heat generating elements are driven on the basis of a recording signal to discharge ink droplets onto the recording medium in the order of dark and light black, dark and light cyan, dark and light magenta, and dark and light yellow, thereby forming an image.

At a home position of carriage selected out of the recording area, a recovery unit 56 having a cap portion 57 is disposed to maintain the stability of ink discharge.

Each of ink jet units and ink cartridges is exchangeable as required.

(Ink jet unit)

Figure 6:
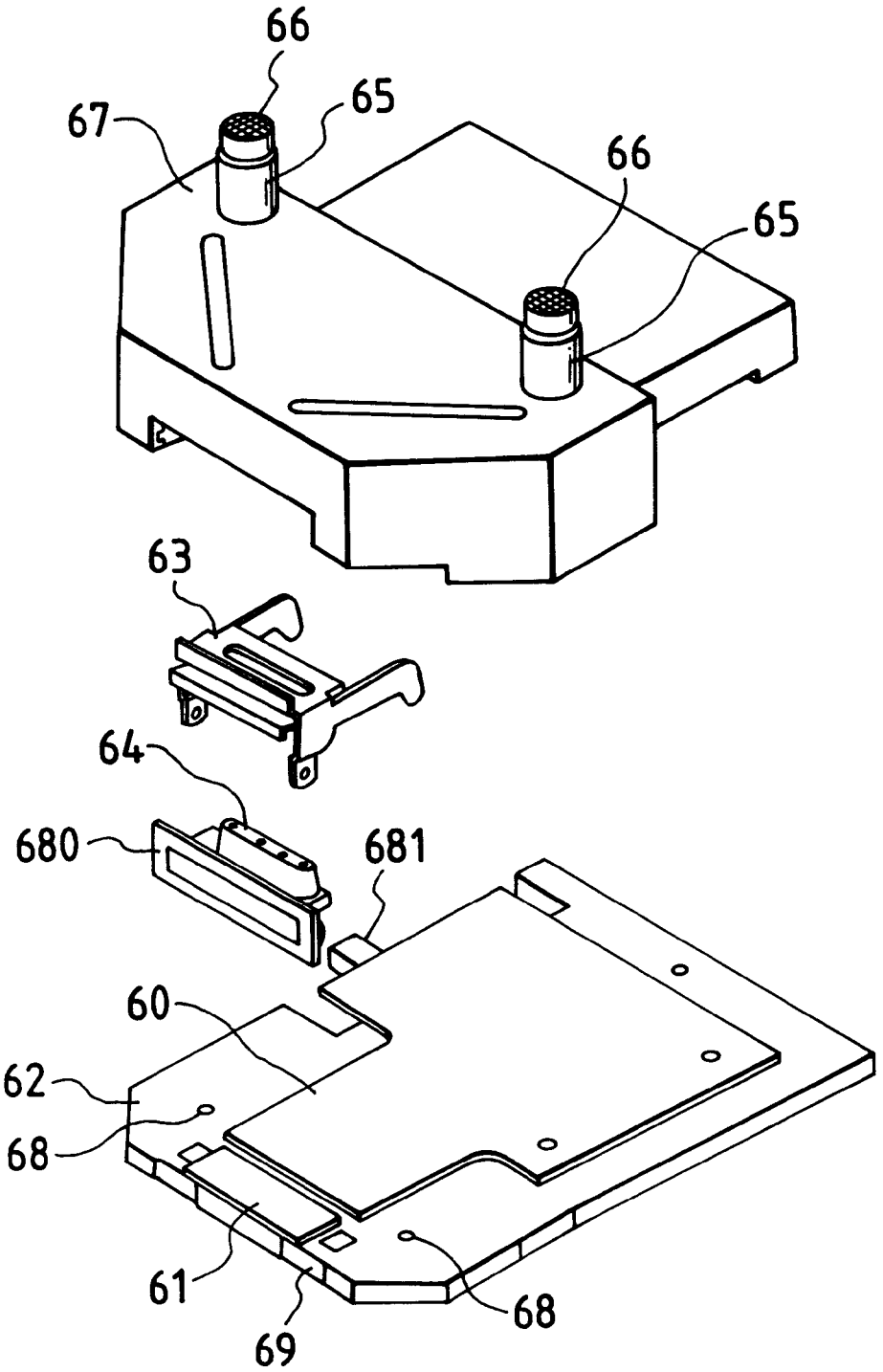
FIG. 6 is a constitutional view of an ink jet unit capable of discharging the dark/light ink.
Figure 8:
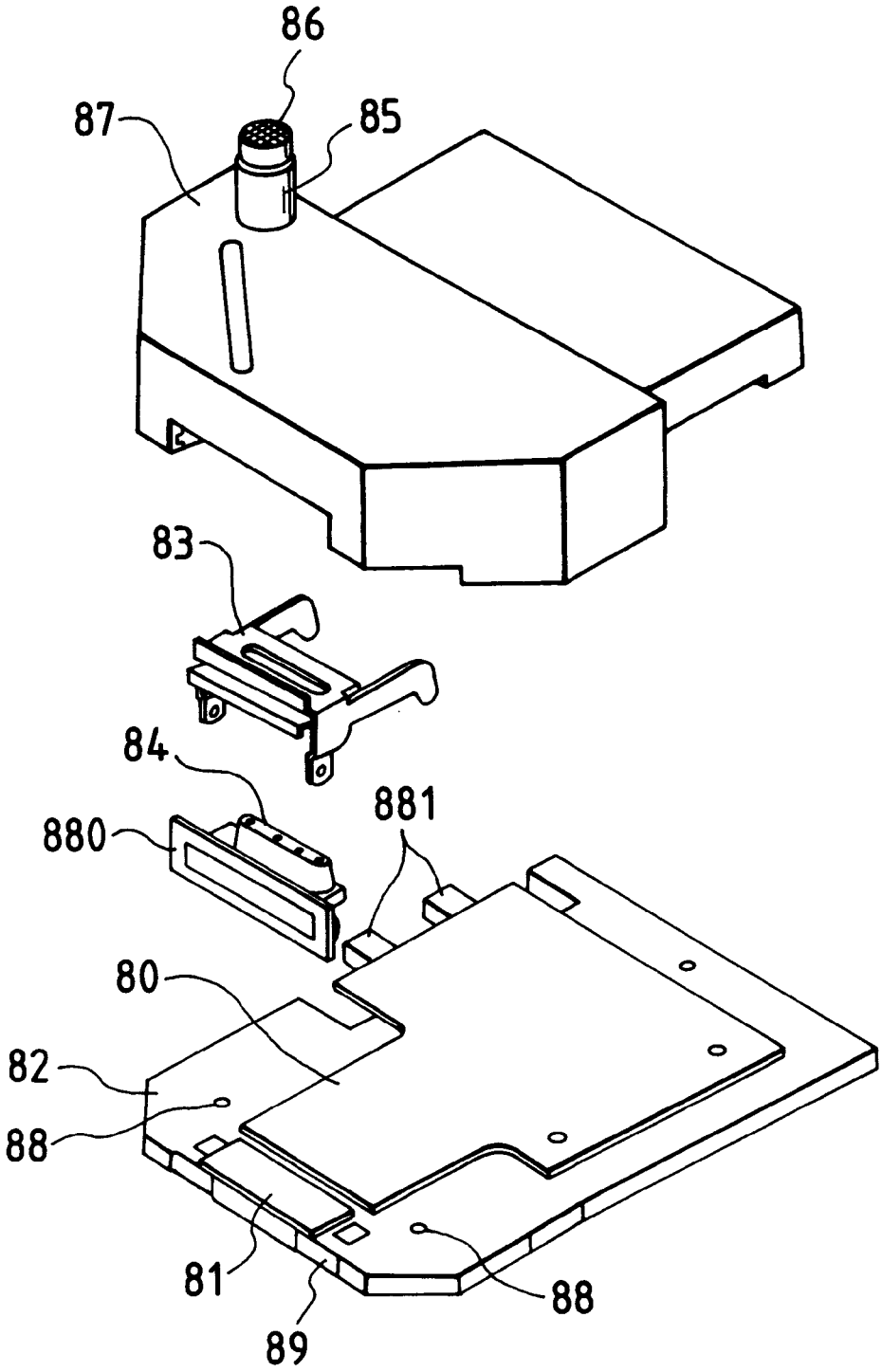
FIG. 8 is a constitutional view of an ink jet unit for discharging the ink of single density.

FIG. 6 is an explanation view for the constitution of an ink jet unit capable of discharging a plurality of inks of different densities for use in this embodiment, and FIG. 8 is an explanation view for the constitution of an ink jet unit for discharging the ink of single density for use in this embodiment.

Both ink jet units have common parts and constitution, though partially different, and will be described together.

One end of a wiring board 60, 80 is interconnected to the wiring part of a heater board 61, 81, and further at the other end of the wiring board 60, 80 there are provided a plurality of pads corresponding to electricity-heat energy converters for accepting an electrical signal from the main device. Thereby, an electrical signal from the main device is supplied to respective electricity-heat energy converter.

A metallic support 62, 82 for supporting the back side of the wiring board 60, 80 in a plane serves as a bottom plate of the ink jet unit. A presser spring 63, 83 has a portion bent into a substantial U-character shape in cross section to apply a pressing force resiliently and linearly on the area in the neighborhood of the ink discharge orifices for a grooved top 64, 84, a hook claw through the use of a relief hole provided on the base plate, and a pair of back legs for receiving a force applied on the spring in the base plate.

By virtue of this spring force, the wiring board 60, 80 and the grooved top 64, 84 are placed into close contact under pressure. Also, the attachment of the wiring board 60, 80 to the support can be bonded by an adhesive.

In the ink jet unit capable of discharging the dark/light ink in this embodiment, two ink supply tubes 65, 66 for supplying the ink are provided corresponding to the dark ink and the light ink.

On the other hand, in the case of an ink jet unit corresponding to the ink of single density, only one ink supply tube 85 is provided.

At the other end of the ink supply tube 65, 85, a filter 66, 86 is provided to prevent impurities from entering the head.

An ink supply member 67, 87 is made by molding and the grooved top has also formed with a flow passageway for conducting the ink into each ink supply opening. The fixture of the ink supply member 67, 87 to the support 62, 82 can be simply performed by passing two pins (not shown) on the back side of the ink supply member 67, 87 into and out of holes 68, 88 provided in the support 62, 82 and heat welding them.

In this case, the interval between an orifice plate portion 680, 880 and a chip tank 67, 87 is formed evenly. A sealing agent is filled through a sealing agent filler hole provided above the ink supply member 127 to seal the wire bonding as well as the gap between an orifice plate 680, 880 and a chip tank 67, 87, further passing through a groove 69, 89 provided on the support 62, 82 to completely seal the gap between the orifice plate portion 680, 880 and the front end of support 62, 82.

Figure 7:
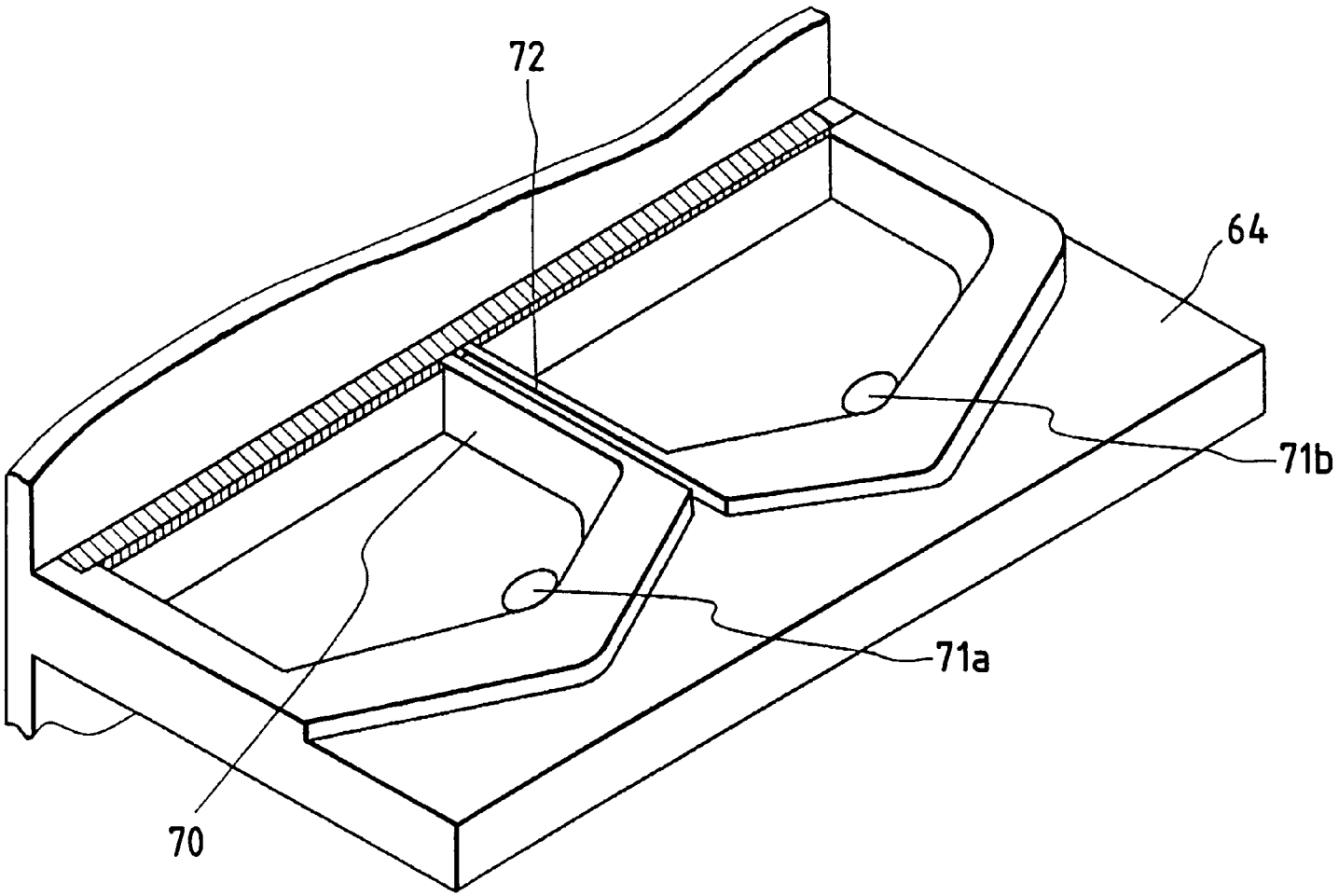
FIG. 7 is a constitutional view of a grooved top for a head unit capable of discharging the dark/light ink.

FIG. 7 is a perspective view of a groove top 64 capable of discharging the dark/light ink for use in this embodiment, as looked from the side of heater board 61. In this unit, two liquid chambers are provided for the dark ink and the light ink, each liquid chamber being divided by a partition 70. Each liquid chamber is provided with supply openings 71*a*, 71*b* for supplying the ink.

A groove 72 is provided on the pressing contact plane of the partition 70 for partitioning this liquid chamber with the heater board 61. This groove communicates to the outer peripheral portion of the grooved top 64. After the grooved top 62 is forced into close contact with the heater board, the outer peripheral portion is sealed by a sealing agent, as previously described. In doing so, the sealing agent percolates into the groove to fill the gap between the grooved top and the heater board. By this technical process, the liquid chamber can be completely separated. The structure of this groove is different with the material of sealing agent, and is necessary to have a corresponding shape.

In this way, by dividing the liquid chamber into plural sections, the ink which is different for each discharge orifice array can be supplied by one ink jet unit.

Figure 9:
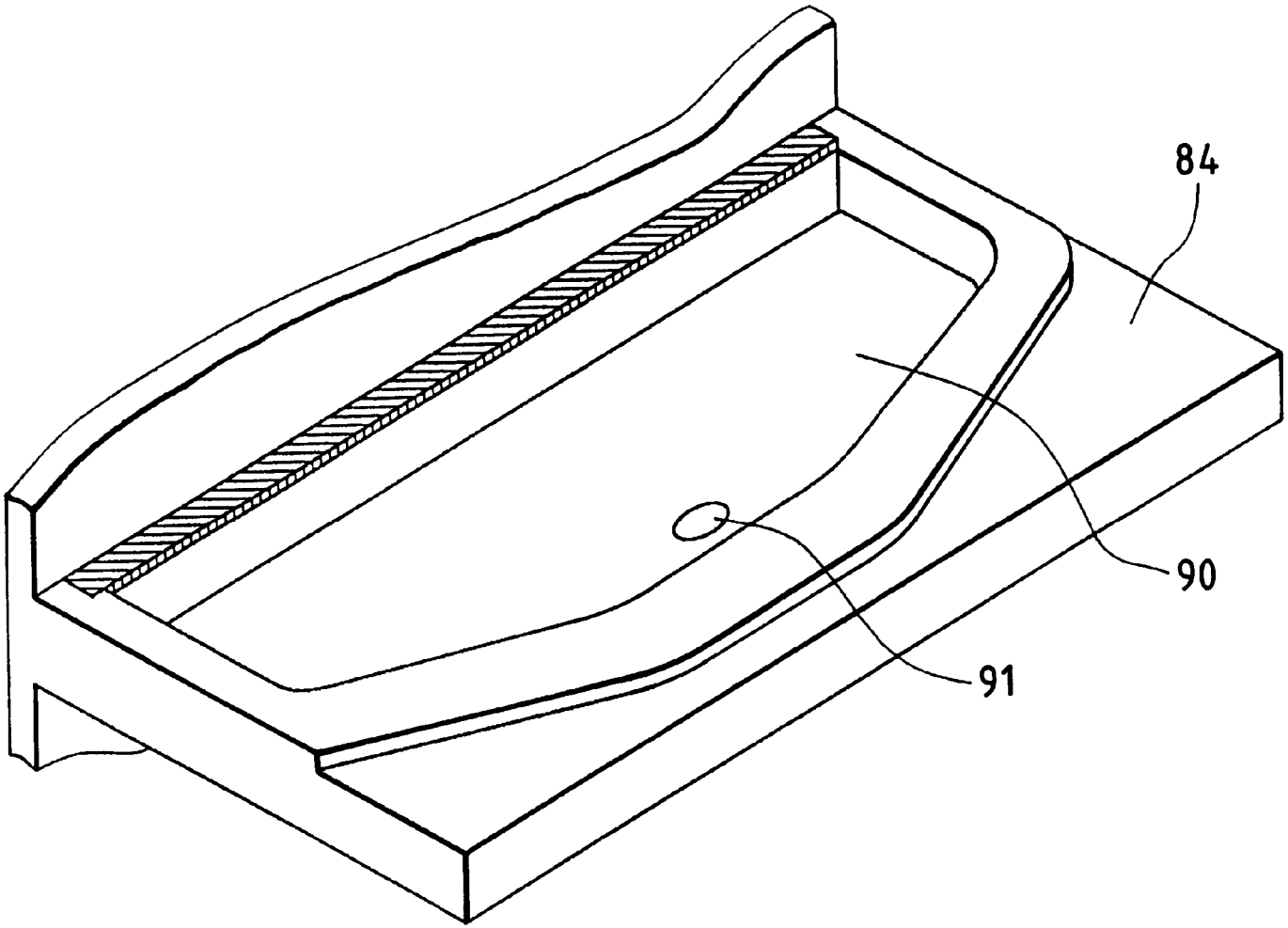
FIG. 9 is a constitutional view of a grooved top for a head unit for discharging the ink of single density.

FIG. 9 is a perspective view of a grooved top 84 of a head unit for discharging the ink of single density for use in this embodiment, as looked from the side of heater board 81. The liquid chamber provided in this unit is a liquid chamber 90 dedicated for the ink of single density. The liquid chamber 90 is provided with a supply opening 91 for supplying the ink.

After the grooved top 84 is forced into close contact with the heater board, the outer peripheral portion is sealed by the same sealing agent as described in connection with FIG. 7.

Figure 10:
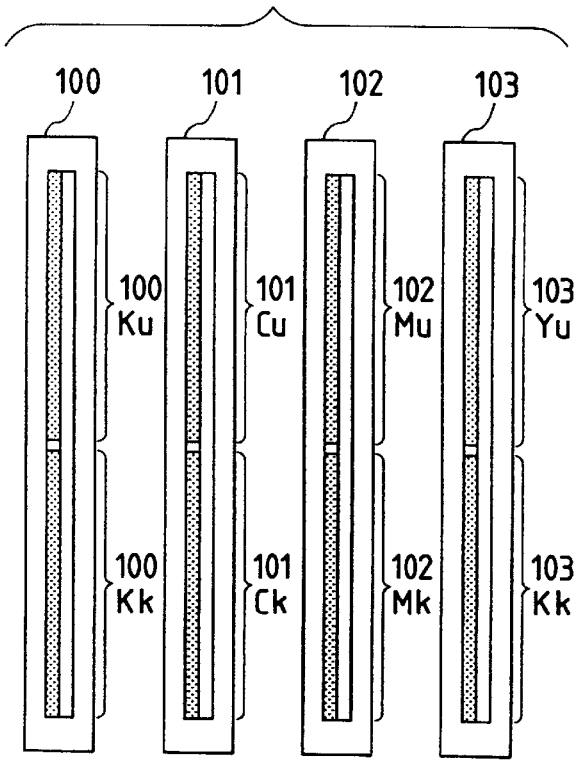
FIG. 10 is a view of the ink discharge orifice array for the ink jet unit capable of discharging the dark/light ink, as looked from the side of the recording medium.

FIG. 10 is a view of ink discharge orifice arrays of an ink jet unit capable of discharging the dark/light ink, as looked from the side of the recording medium.

There are provided an ink jet unit 100 for discharging the black ink, an ink unit 101 for discharging the cyan color ink, an ink jet unit 102 for discharging the magenta color ink, and an ink jet unit 103 for discharging the yellow color ink.

Also, 100Ku, 101Cu, 102Mu and 103Yu are discharge orifice arrays for discharging the light ink, and 100Kk, 101Ck, 102Mk and 103Yk are discharge orifice arrays for discharging the dark ink.

Each discharge orifice array corresponding to each dark/light ink has 64 discharge orifices at a pitch of 360 dots per inch (360 dpi), wherein there is a blank of 8 dots between each color array by virtue of the partition of liquid chamber.

Figure 11:
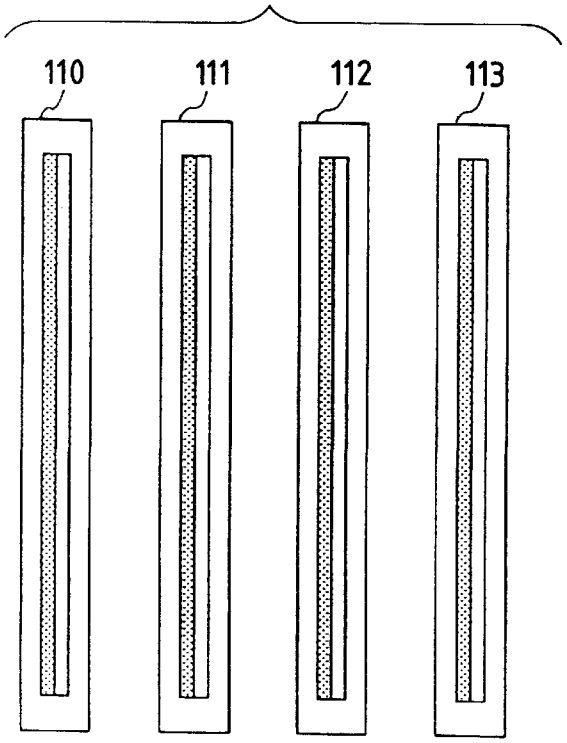
FIG. 11 is a view of the ink discharging orifice array for the ink jet unit for discharging the ink of single density, as looked from the side of the recording medium.

FIG. 11 is a view of ink discharge orifice arrays wherein an ink jet unit for discharging the ink of single density is arranged for each color, as looked from the side of the recording medium.

There are provided an ink jet unit 110 for discharging the black ink, an ink jet unit 111 for discharging the cyan color ink, an ink jet unit 112 for discharging the magenta color ink, and an ink jet unit 113 for discharging the yellow color ink.

Each ink jet unit has discharge orifices arranged at a pitch of 360 dots per inch (360 dpi), with 128 discharge orifices provided for each one of head units.

Figure 12:
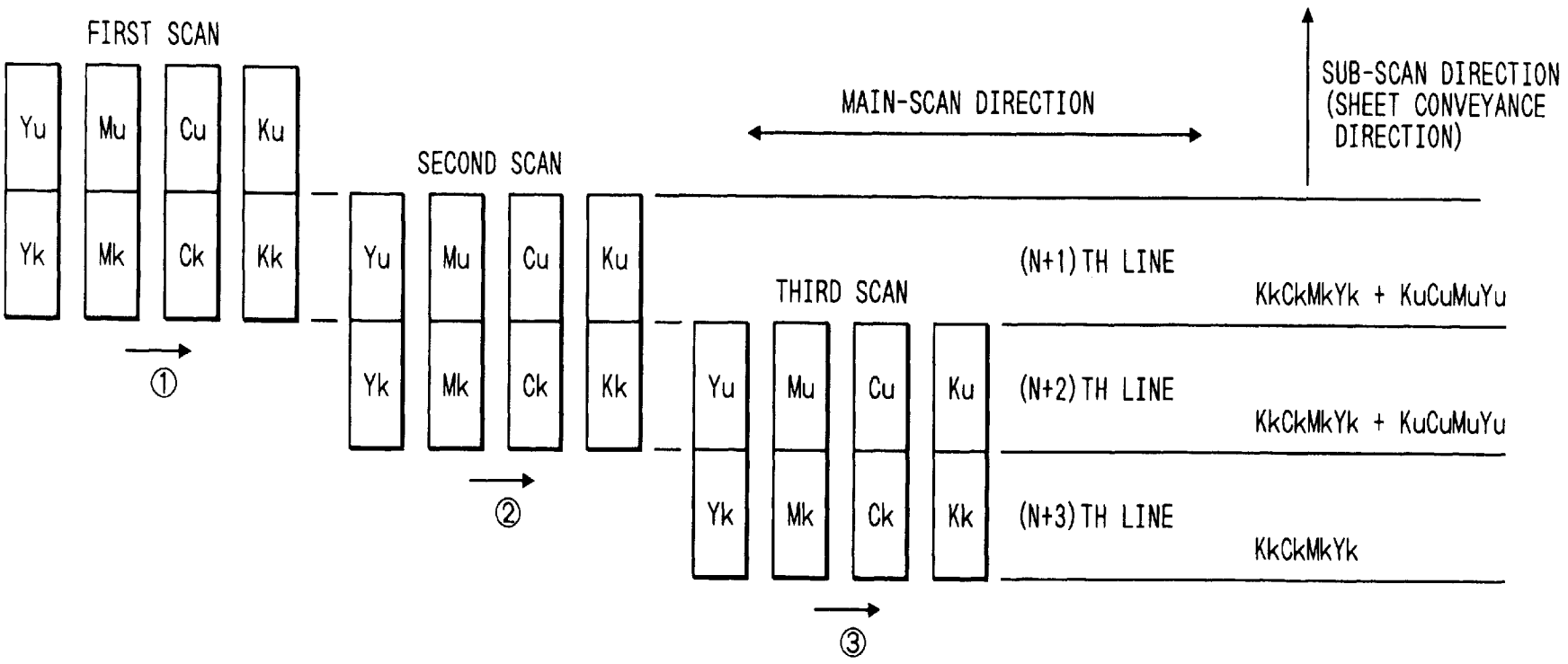
FIG. 12 is a diagram showing an image formation process where the ink jet unit capable of discharging the dark/light ink is mounted.

FIG. 12 is a view showing an image formation process wherein an ink jet unit capable of discharging the dark/light ink is mounted.

In the explanation of this figure, the image formation process will be described, supposing that no blank is provided between each color.

Noting the (N+1)th line, the recording in dark black, dark cyan, dark magenta and dark yellow and the conveying operation (line feed, hereinafter abbreviated as LF) of the recording medium by a predetermined amount is performed at the first scan line, and the recording in light black, light cyan, light magenta and light yellow and the LF is performed at the second scan line, whereby such two scan recordings can complete an image. The amount of LF after each scan recording is 64 dots wide, and the image 64 dots wide is recorded by the second scan recording.

The recording in all colors which is not completed by one time of the scan recording will result in less degradation in image quality due to blur and thus produces an excellent image. Further, in the actual ink jet unit, owing to a blank provided between each color, the connecting position of the recording scan for each color is not coincide for each color, as depicted in this figure, and located at a different position, so that there is the effect that the occurrence of connection streaks of the recording scan is relieved.

Figure 13:
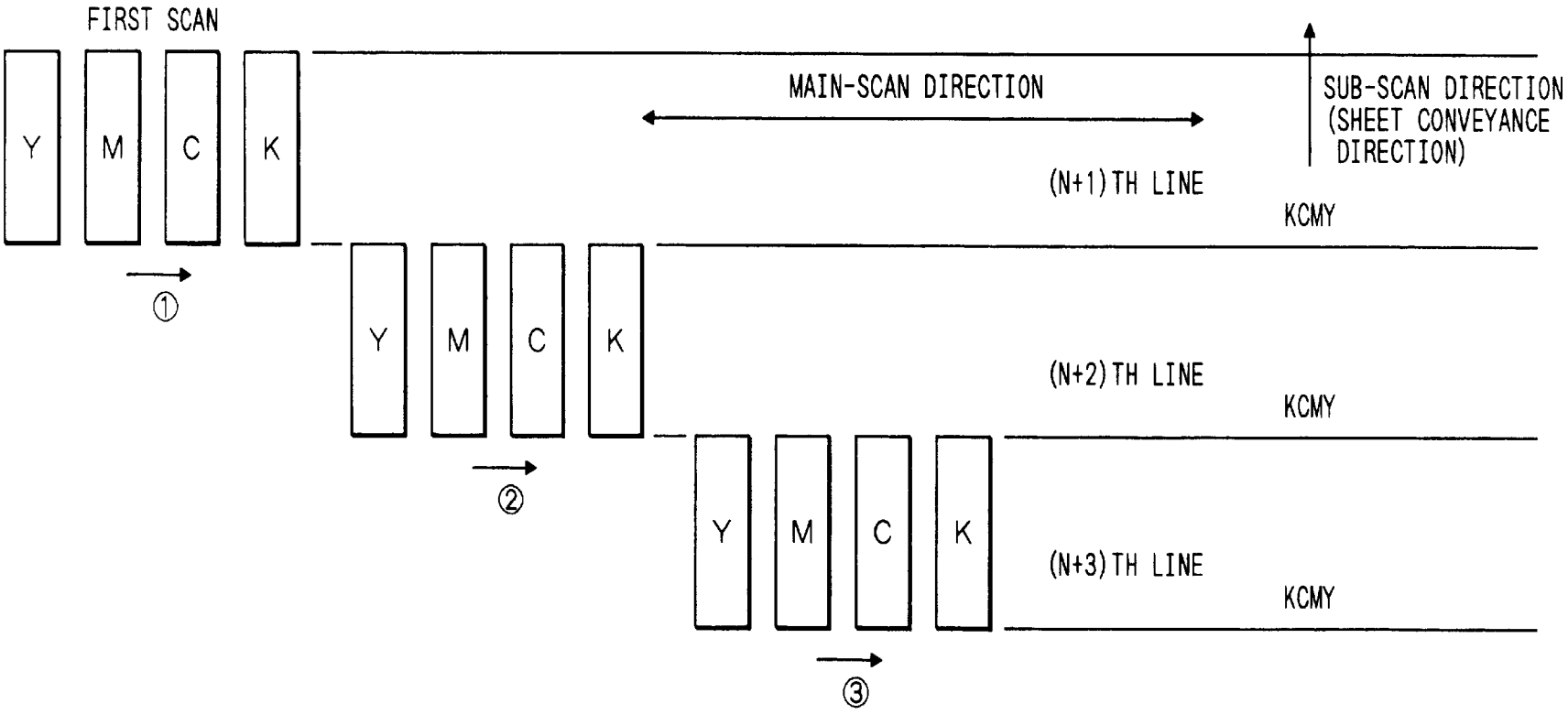
FIG. 13 is a diagram showing an image formation process where the ink jet unit for discharging the ink of single density is mounted.

FIG. 13 is a diagram showing an image formation process wherein an ink jet unit for discharging the ink of single density is mounted.

By the first scan and the LF, the recording in black, cyan, magenta and yellow is performed to complete the image at the (N+1)th line. Then, by the second scan recording and the LF, and the third scan recording and the LF, the images at the (N+1)th line and at the (N+1)th line are completed. The amount of LF after each scan recording is 128 dots wide, whereby the image 128 dots wide is recorded by one time of the scan recording.

Figure 14A:
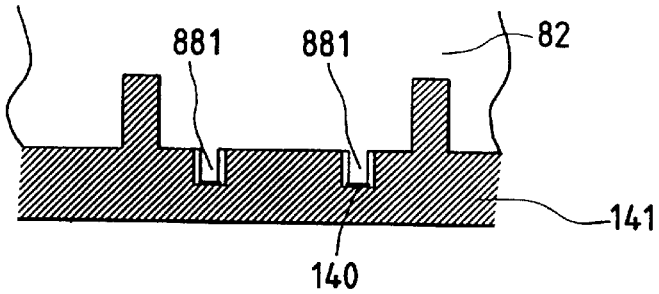
FIGS. 14A and 14B are explanation views of means for passing designated information of ink jet unit to the apparatus main.
Figure 14B:
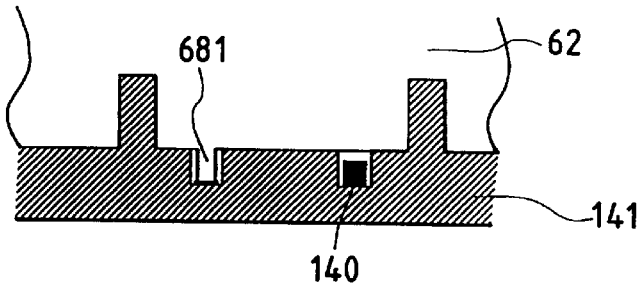

FIGS. 14A and 14B are explanation views of means for transmitting designated information of an ink jet unit to the apparatus main, shown partially in cross section.

141 is a carriage, 140 is a switch provided on the carriage 141, and 62, 82 is a support for the ink jet unit. When the ink jet unit is mounted on the carriage, the number of switches which are turned on is determined by the number of signal pins provided on the support 62, 82 of the ink jet unit.

FIG. 14A shows the state where an ink jet unit for discharging the ink of single density is mounted, with all the switches 140 turned on. In this case, the apparatus main is informed that the ink jet unit for discharging the ink of single density is mounted, and a dark/light distribution table of FIG. 3A is selected, whereby the recording through the image formation process as described in FIG. 13 is performed.

FIG. 14B is a view wherein an ink jet unit capable of discharging a plurality of inks of different densities is mounted, with only one switch turned on. The apparatus main is informed that the ink jet unit capable of discharging the inks of different densities is mounted, and a dark/light distribution table of FIG. 3B is selected, whereby the recording through the image formation process as described in FIG. 12 is performed.

This embodiment as above described has been configured to provide the signal pin on the support of the ink jet unit as designated information generating means for changing the recording control in accordance with the ink jet unit mounted therein, when the ink jet unit for discharging the ink of single density or the ink jet unit capable of discharging the inks of different densities is mounted.

With this embodiment, information can be passed to the recording apparatus main by changing the number of signal pins provided on the ink jet unit in accordance with the designated content of the recording control, whereby an appropriate dark/light distribution table can be selected and the recording control method can be set simply by mounting the ink jet unit on the carriage.

Note that the designated information generating means is not limited to that as shown in this embodiment, but a host computer connecting to the recording apparatus, a dip switch for the host computer or the recording apparatus, an operation key on the operation panel, or memory means provided on the recording apparatus may be used. Another configuration is also possible wherein memory means is provided on the ink jet unit, and the information within memory is read by the apparatus main.

With this embodiment, the recorded matter of image which is excellent in gradation and resolution and has reduced graininess can be obtained.

(Second embodiment)

The second embodiment of the present invention will be now described.

Figure 15:
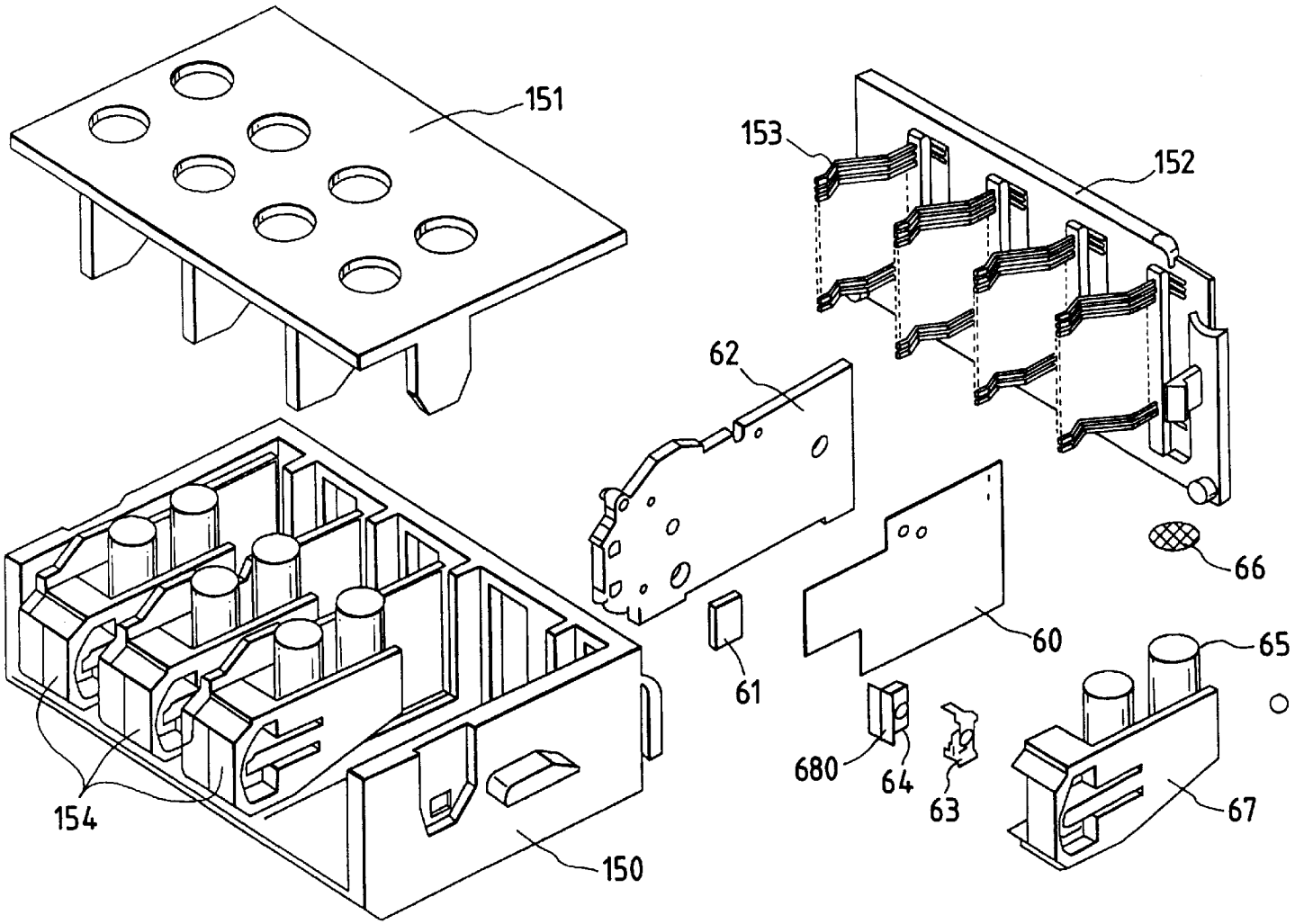
FIG. 15 is a view showing the constitution of an integral ink jet cartridge capable of discharging the dark/light ink in accordance with another embodiment of the present invention.

FIG. 15 shows the construction of an integral ink jet cartridge wherein ink jet units 154 capable of discharging the dark/light ink for four colors of yellow, magenta, cyan and black are integrally assembled into a frame 150.

Figure 17:
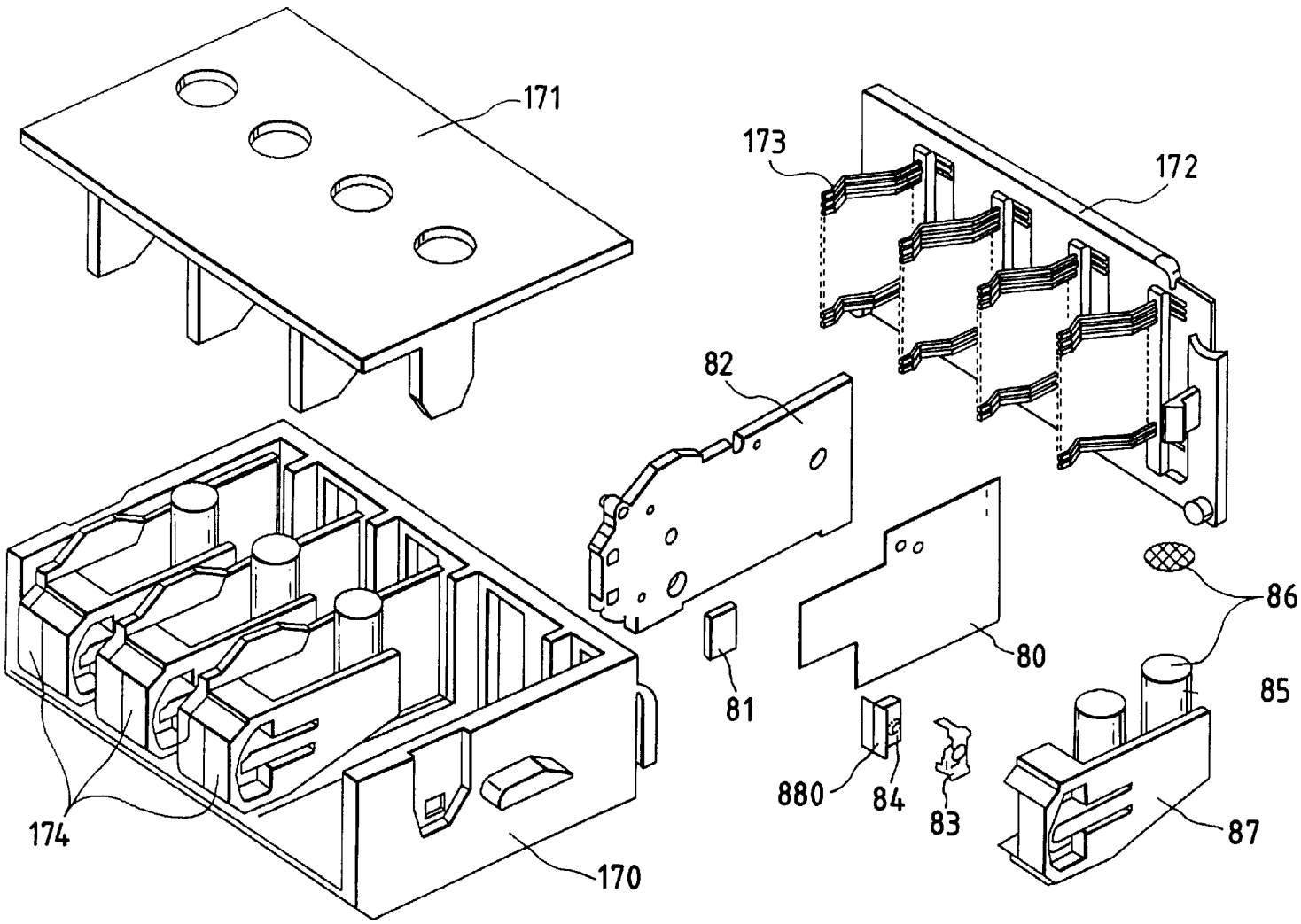
FIG. 17 is a view showing an integral ink jet cartridge for discharging the ink of single density.

FIG. 17 shows the construction of an integral ink jet cartridge wherein ink jet units 174 for discharging the ink of single density for four colors of yellow, magenta, cyan and black are integrally assembled into a frame 170.

The integral ink jet cartridges as shown in FIGS. 15 and 17 have common parts and constitution, though partially different, and will be described together.

The constitution of the ink jet unit 154, 174 has been described in detail in the previous embodiment, and will be no longer described.

Four ink jet units 154, 174 as shown in FIGS. 15 and 17 are mounted a predetermined interval apart within the frame 150, 170, and fixed with the registration in a direction of nozzle array adjusted. 151, 171 is a frame cover, and 152, 172 is a connector for connecting pads provided on the wiring board 60, 80 for the four ink jet units 154, 174 with the apparatus main to provide an electrical signal. The wiring board 60, 80 and the connector 152, 172 are connected through electrodes 153, 173, respectively.

Figure 16:
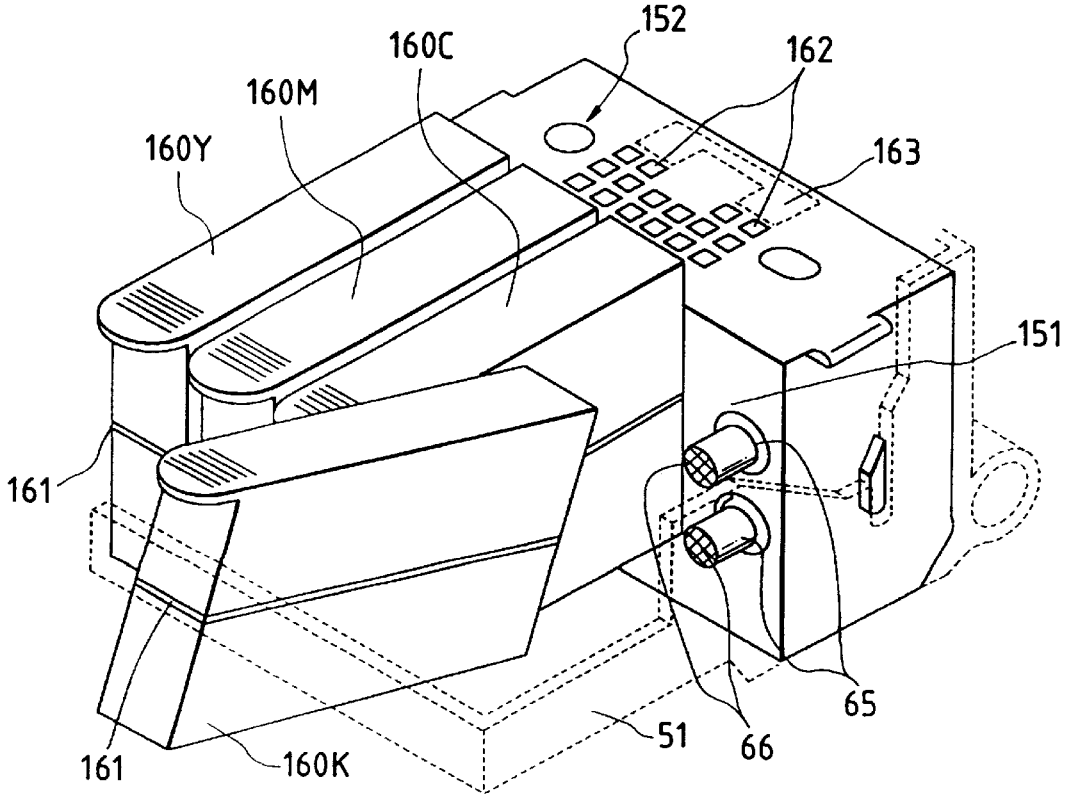
FIG. 16 is a view showing how the integral ink jet cartridge as shown in FIG. 15 is mounted on the carriage.

FIG. 16 shows how an integral ink jet cartridge 152 capable of discharging the inks of different densities is mounted on the carriage 51.

Figure 18:
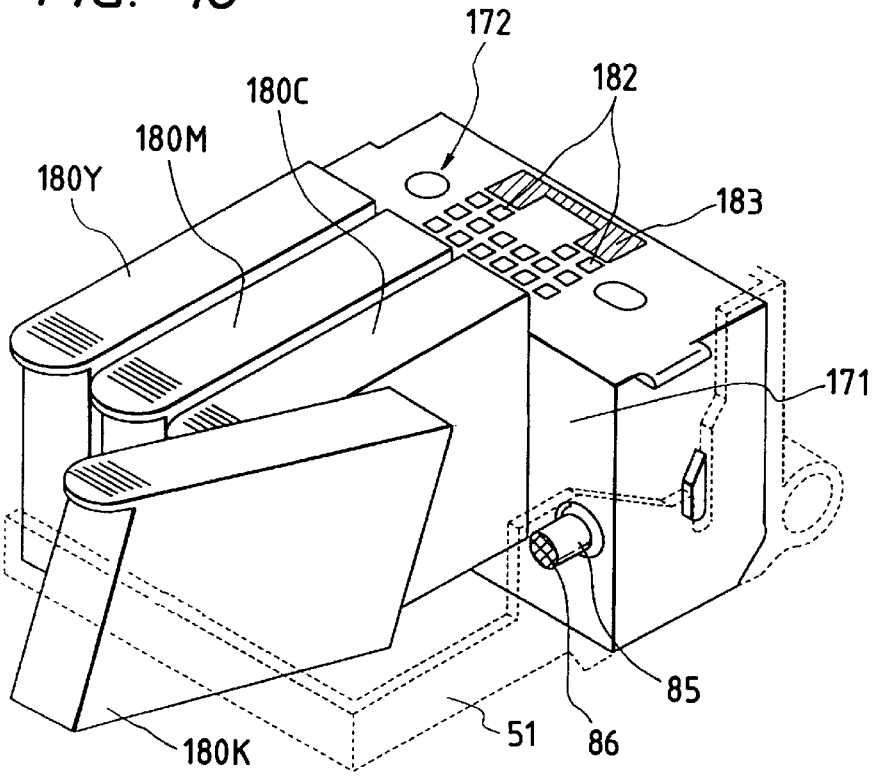
FIG. 18 is a view showing how the integral ink jet cartridge as shown in FIG. 17 is mounted on the carriage.

FIG. 18 shows how an integral ink jet cartridge 172 for discharging the ink of single density is mounted on the carriage 51.

An ink tank 160 for storing the inks of different densities is partitioned into two upper and lower chambers by a partition 161, an upper chamber filled with the light ink and a lower chamber filled with the dark ink.

An ink tank 180 for storing the ink of single density has no partition for serving to receive different inks. And an ink jet cartridge 152, 172 and four ink tanks 160, 180 of yellow, magenta, cyan and black are connected together on the carriage 51, and the ink is supplied from the ink tank 160, 180 to corresponding ink discharge orifice array.

As shown in FIG. 18, an electrically conductive seal 183 is pasted on the integral ink jet cartridge 172 for discharging the ink of single density. On the other hand, no electrically conductive seal is pasted on the integral ink jet cartridge 152 capable of discharging the inks of different densities, as indicated by 163 in FIG. 16.

The recording apparatus main body in this embodiment has two electrode contacts at the positions corresponding to the electrically conductive seal by mounting the integral ink jet cartridge thereto.

When any electrically conductive seal exists on a portion indicated by 183 as shown in FIG. 18, two electrode contacts provided on the main body as above described are placed in conduction, the apparatus main is informed that the integral ink jet cartridge for discharging the ink of single density is mounted, and a dark/light distribution table of FIG. 3A is selected, whereby the recording through the image formation process as depicted in FIG. 13 is performed. Also, when no electrically conductive seal exists on a portion indicated by 163 as shown in FIG. 16, two corresponding electrodes provided on the main body are not in conduction, the apparatus main is informed that the integral ink jet cartridge capable of discharging the dark/light ink is mounted, and a dark/light distribution table of FIG. 3B is selected, whereby the recording through the image formation process as depicted in FIG. 12 is performed.

With this embodiment, by placing the corresponding contacts on the side of the recording apparatus main body in conduction or non-conduction depending on whether or not any electrically conductive seal of the integral ink jet cartridge exists, information can be transferred to the recording apparatus main body, an appropriate dark/light distribution table can be selected, and the recording control method can be set simply by mounting the recording head on the carriage.

With this embodiment, the recorded matter of image which is excellent in gradation and resolution and has reduced graininess can be obtained.

(Third embodiment)

A third embodiment of the present invention will be now described.

Figure 19:
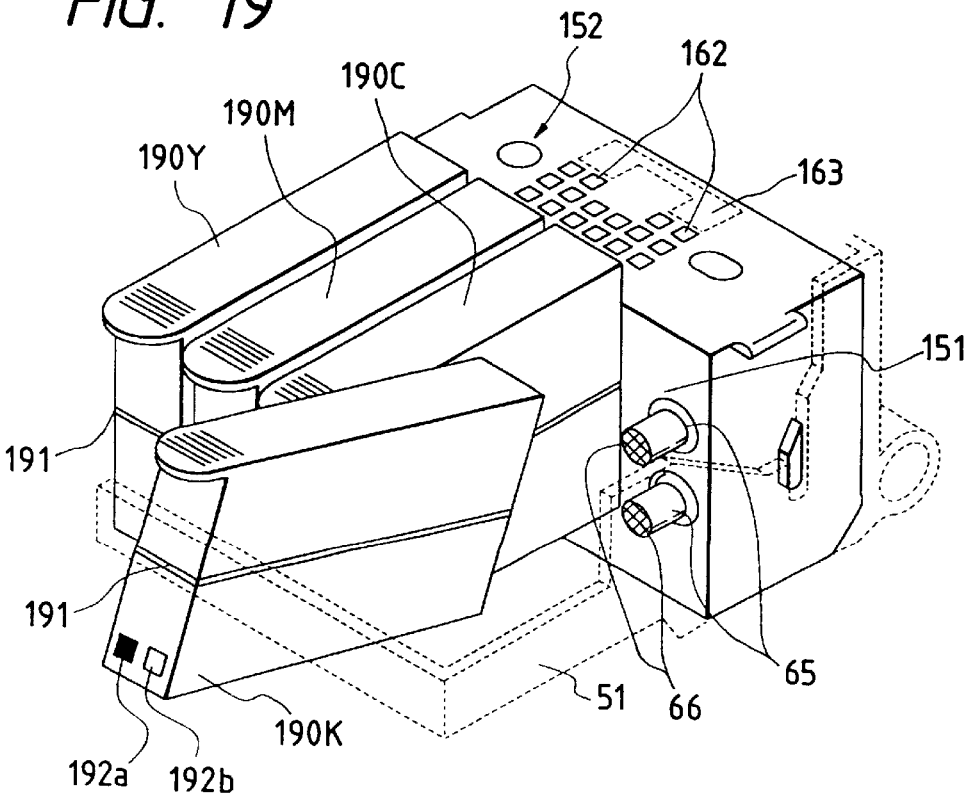
FIG. 19 is a view showing how an integral ink jet cartridge capable of discharging the inks of two densities in accordance with another embodiment of the present invention is mounted on the carriage.

FIG. 19 shows how an integral ink jet cartridge 152 is mounted on a carriage 51, wherein ink jet units capable of discharging two different inks through corresponding arrays of discharge orifices with a liquid chamber divided into two sections are integrated.

This ink jet units and the integral ink jet cartridge 152 are identical to the ink jet units capable of discharging the inks of different densities and the integral ink jet cartridge thereof as described in the previous embodiment, respectively.

Figure 21:
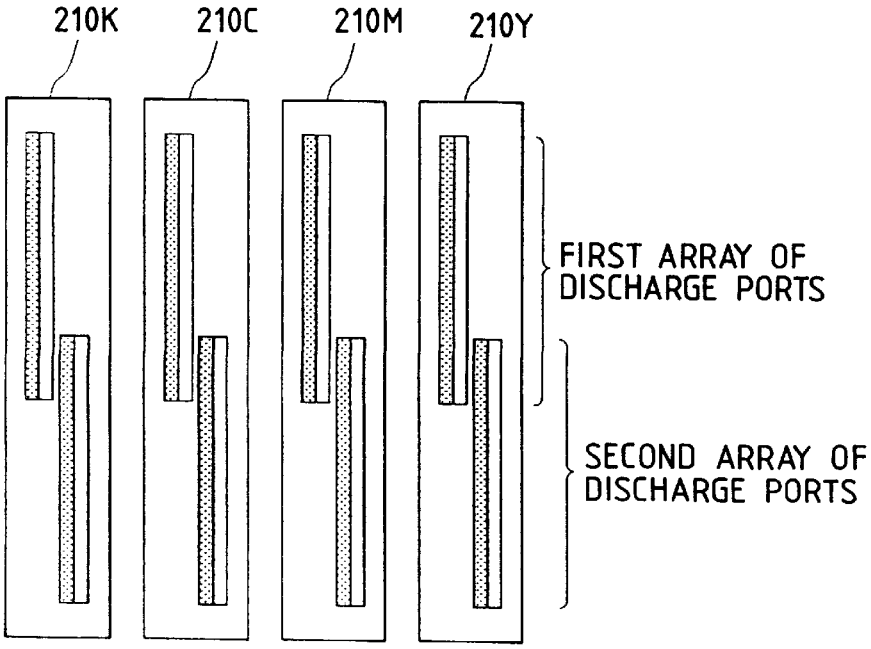
FIG. 21 is a view of the ink discharge orifice arrays in the integral ink jet cartridge as shown in FIG. 19, as looked from the side of recording medium.

FIG. 21 is a view of ink discharge orifice arrays for an integral ink jet cartridge capable of discharging two different inks used in this embodiment through corresponding arrays of discharge orifices, as looked from the side of recording medium.

There are provided an ink jet unit 210Y for discharging the yellow color ink, an ink jet unit 210M for discharging the magenta color ink, an ink jet unit 210C for discharging the cyan color ink, and an ink jet unit 210K for discharging the black color ink.

Each ink jet unit 210 has a first discharge orifice array and a second discharge orifice array, each array capable of discharging a different ink.

Each discharge orifice array has arranged discharge orifices at a density of 360 dots per inch (360 dpi). The first discharge orifice array and the second discharge orifice array are 64 discharge orifices usable for the recording, respectively, with no blank in a direction of discharge orifice array provided between discharge orifice arrays usable for the recording, as previously described. That is, an ink jet unit for discharging the ink of single density having 128 discharge orifices may be constructed in such a way that discharge timing correction is made by the amount of deviation in a main scan direction between the first discharge orifice array and the second discharge orifice array, and the same ink is supplied and discharged to and from the first discharge orifice array and the second discharge orifice array.

In FIG. 19, an ink tank 190 is partitioned into two upper and lower chambers by a partition 191, wherein the upper and lower chambers can contain different inks.

And an ink jet cartridge 152 and four ink tanks 190 of yellow, magenta, cyan and black are connected together on a carriage 51, the ink being supplied from the ink tank 190 to a corresponding ink discharge orifice array.

192*a*, 192*b* is a marking indicating the information of ink tank.

In this embodiment, when a marking 192*a* is black and 192*b* is white, an dark/light ink corresponding ink tank is indicated containing the light ink in the upper chamber and the dark ink in the lower chamber with the partition within the ink tank, as shown in FIG. 19. On the other hand, when the markings 192*a*, 192*b* are both black, a single density ink corresponding ink tank is indicated containing the thick ink within the upper and lower chambers.

Figure 20:
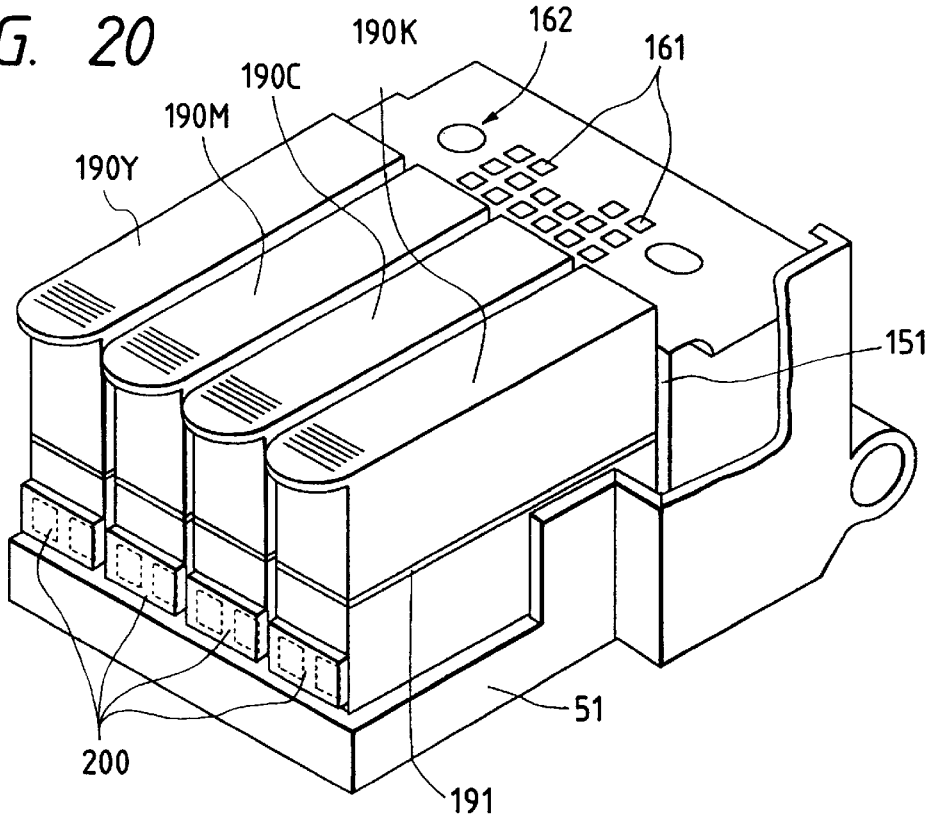
FIG. 20 is a view showing the state of the integral ink jet cartridge as shown in FIG. 10 where all the ink cartridges are mounted on the carriage.

FIG. 20 is a view showing the state wherein all the ink tanks are mounted on the carriage.

Markings 192*a*, 192*b* for the ink tank 190 are detected by means of an optical sensor 200 provided on the carriage 51.

Herein, an image formation process will be described below with reference to FIG. 22, wherein the black ink tank corresponds to the single density ink in which the optical sensor 200 discriminates both the markings 192*a*, 192*b* as black, while the other color ink tank corresponds to the dark/light ink in which the optical sensor 200 discriminates the marking 192*a* as black and the marking 192*b* as white.

Figure 22:
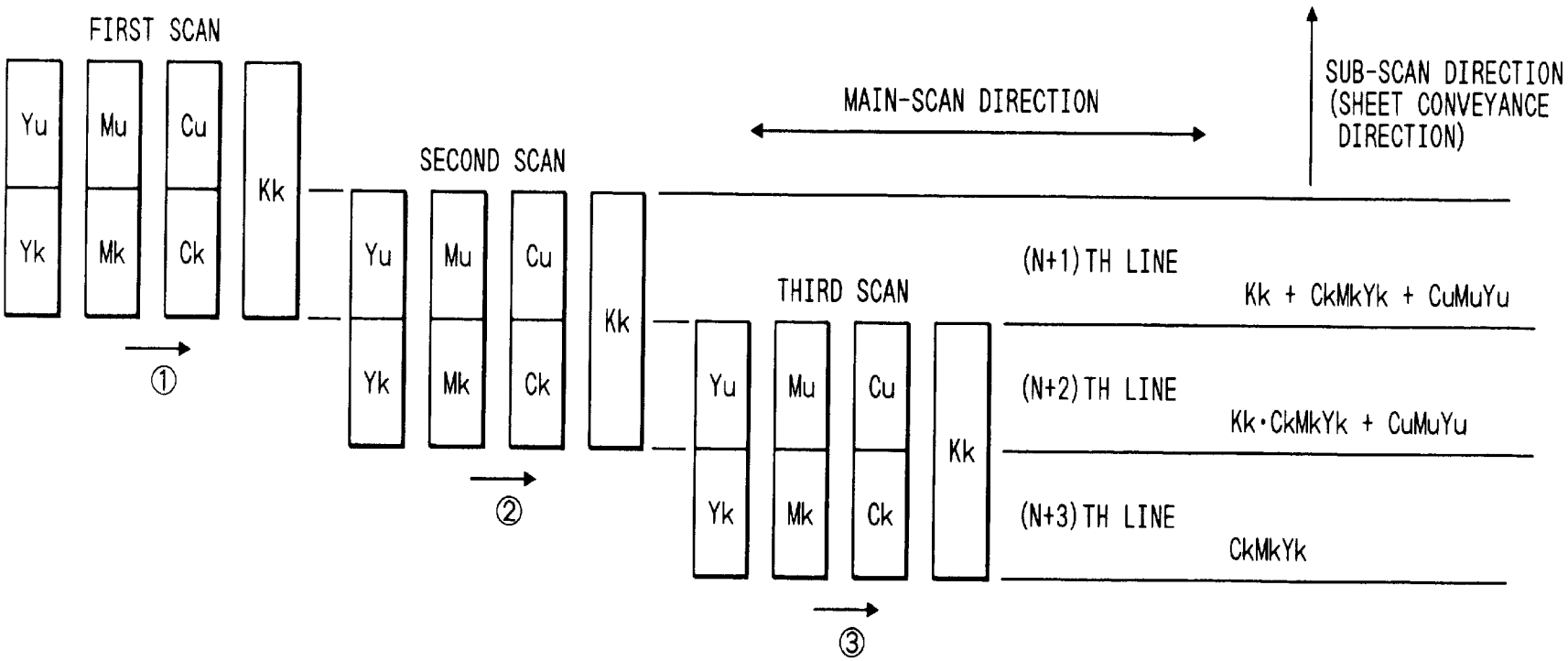
FIG. 22 is a view exemplifying an image formation process using the integral ink jet cartridge as shown in FIG. 19.
Figure 23:
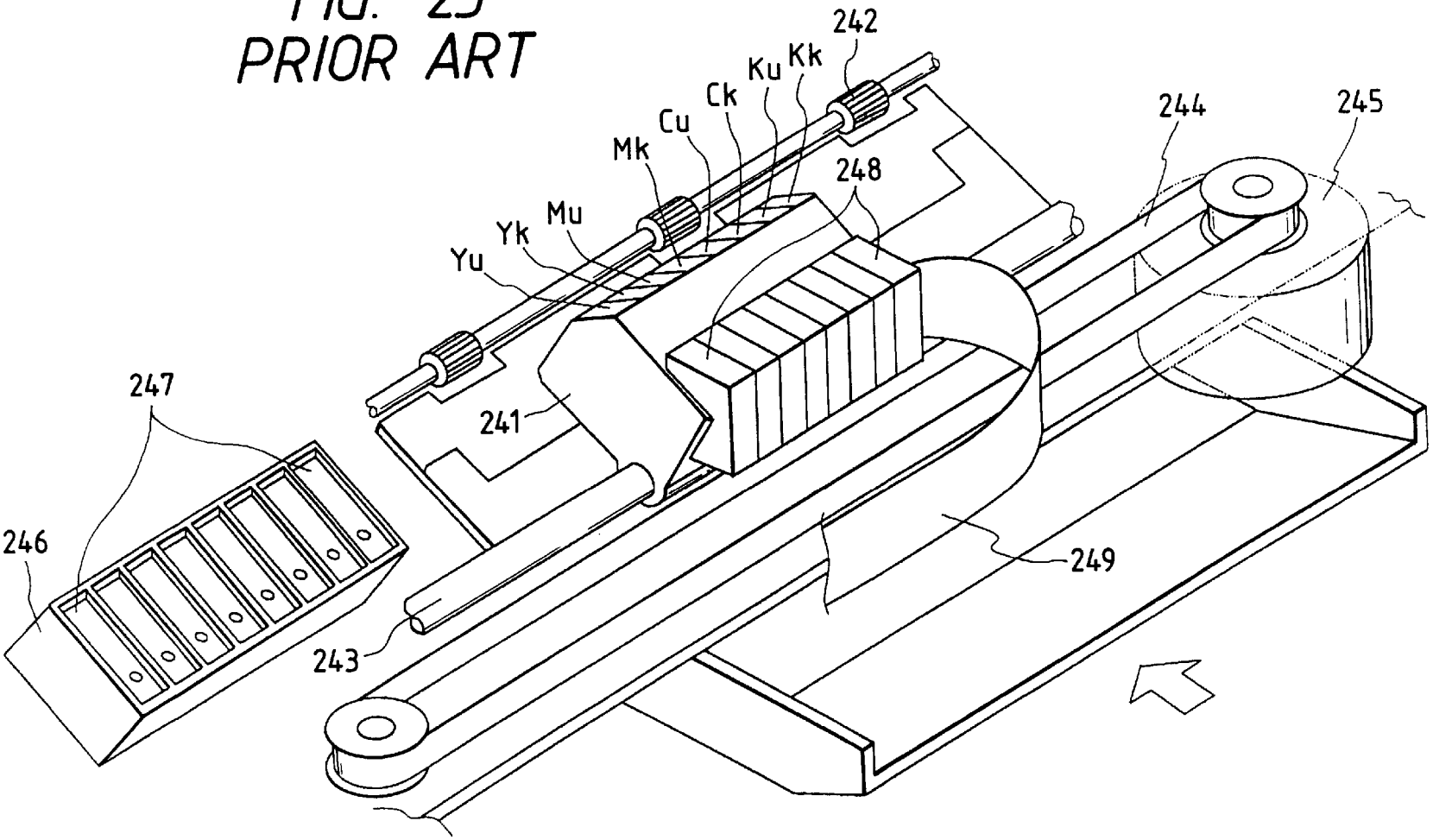
FIG. 23 PRIOR ART
FIG. 23 is a perspective view showing the essence of a conventional color ink jet recording apparatus using the dark/light ink.

FIG. 22 is a view showing the image formation process.

For the black dark/light distribution table, FIG. 3A is selected and set, according to designated information of the ink tank by the optical sensor, and for the dark/light distribution table of yellow, magenta and cyan, FIG. 3B is selected and set.

In FIG. 22, noting the (N+2)th line, the recording in dark black, dark cyan, dark magenta and dark yellow and the LF are performed at the second scan, and the recording in light cyan, light magenta, and light yellow and the LF are performed at the third scan, whereby an image is completed by two scan recordings.

The amount of LF after each scan recording is 64 dots wide, and the image 64 dots wide is recorded by two scan recordings.

The recording in dark black occurs only at the second scan in the figure, and thus at every other scan, in which the recording 128 dots wide which is double that of yellow, magenta and cyan is performed once.

With such a constitution, the recording speed can be increased by varying the amount of LF to the width of 128 dots when printing black characters or in monochrome.

With this embodiment, the marking state is changed according to designated information preset in the ink tank, and detected by the optical sensor upon mounting the ink tank, whereby an appropriate dark/light distribution table can be selected and the recording control method set.

Further, it is preferable to provide an automatic suction recovery mode of fully exchanging the ink in a liquid chamber and discharge orifices within an ink jet unit in such a way as to allow the recovery unit to perform the suction recovery operation upon discriminating the replacement to the different ink tank by detecting the marking state of the ink tank to be changed.

Note that designated information generating means for generating designated information by detecting the marking is not limited to that shown in this embodiment, but may be a host computer connecting to the recording apparatus.

As above described in the embodiment, the recording control can be altered upon detecting the marking provided, simply by exchanging the ink jet unit, the ink jet cartridge or the ink tank, when outputting the image having significance on the graininess and gradation reproducibility such as a so-called pictorial image composed of gradation representation or when attaching great importance on the recording speed such as when printing characters, graphics and listing, whereby the image can be output with a desired image quality and at the recording speed.

With this embodiment, the image excellent in gradation and resolution and with reduced graininess can be obtained.

The present invention brings about excellent effects particularly in a recording head or a recording device of the ink jet system for performing the recording by forming flying fine ink droplets by the use of heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink.), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, the recording head of the full line type having a length corresponding to the maximum width of a recording medium which can be recorded by the recording device may be either the constitution which satisfies its length by a combination of a plurality of recording heads as disclosed in the above-cited specifications or the constitution as one recording head integrally formed.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Though the ink is considered as the liquid in the embodiments as above described, another ink may be also usable which is solid below room temperature and will soften or liquefy at or above room temperature, or liquefy when a recording signal is issued as it is common with the ink jet device to control the viscosity of ink to be maintained within a certain range of the stable discharge by adjusting the temperature of ink in a range from 30° C. to 70° C.

In addition, in order to avoid the temperature elevation due to heat energy by positively utilizing the heat energy as the energy for the change of state from solid to liquid, or to prevent the evaporation of ink by using the ink which will solidify in the shelf state, the use of the ink having a property of liquefying only with the application of heat energy, such as liquefying with the application of heat energy in accordance with a recording signal so that liquid ink is discharged, or is already solidifying upon reaching the recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on the film boiling.

Further, a recording apparatus according to the present invention may be provided integrally or separately as the image output terminal of information processing equipment such as a computer or word processor, or the copying machine in combination with a reader, or the facsimile apparatus having the transmission and reception feature.

Figure 24:
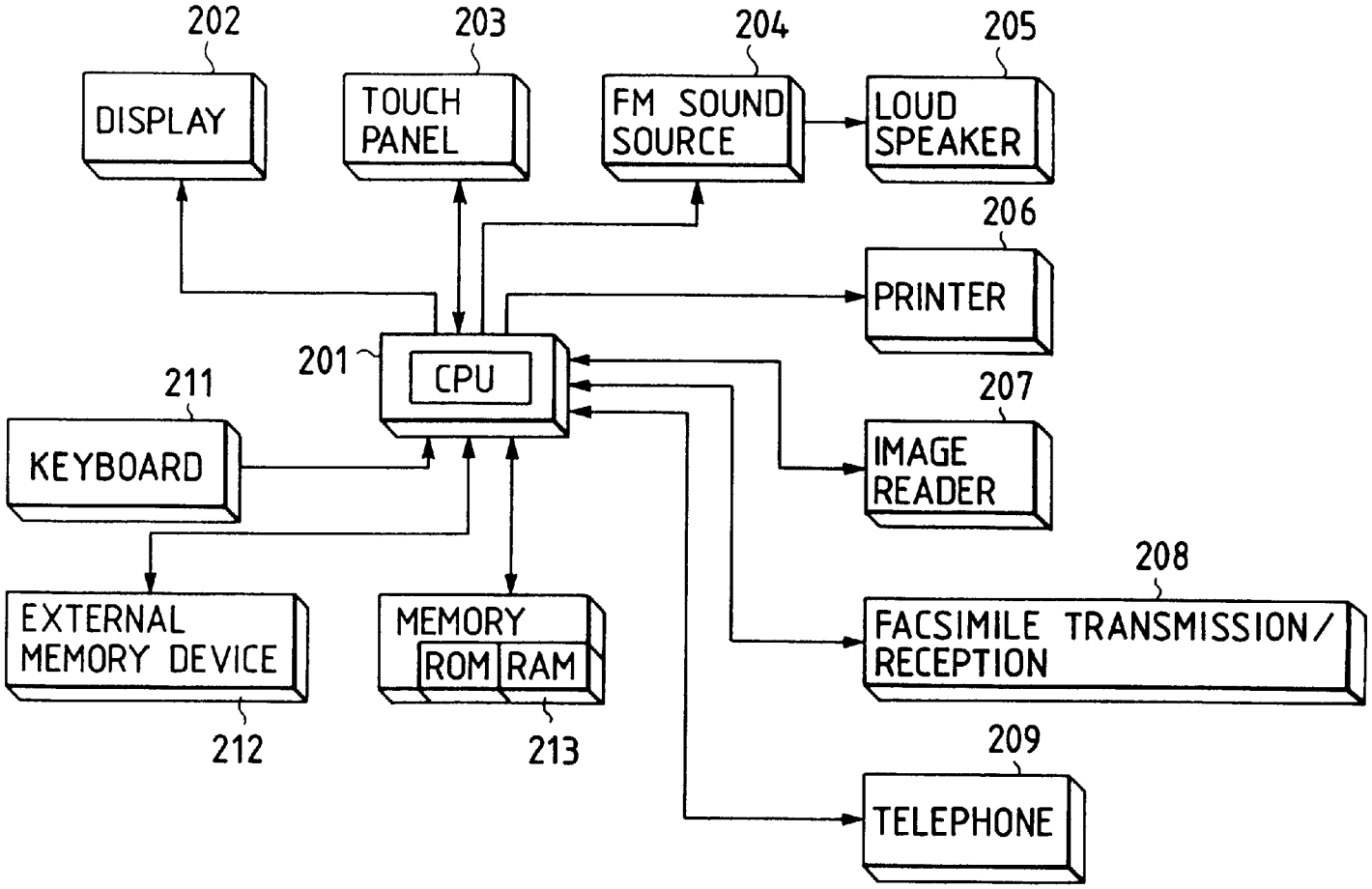
FIG. 24 is a block diagram showing a schematic configuration where a recording apparatus of the present invention is applied to an information processing apparatus.

FIG. 24 is a block diagram showing a schematic configuration in which a recording apparatus of the present invention is applied to an information processing apparatus having the features of word processor, personal computer, facsimile apparatus, copying machine and electronic typewriter. In the figure, 201 is a control unit for controlling the whole apparatus, comprised of a CPU such as a microprocessor or various I/O ports, this control unit controlling each unit by outputting or inputting control signal or data to or from it. 202 is a display unit for displaying various menus, document information, and image data read by an image reader 207 on its display screen. 203 is a transparent, pressure sensitive touch panel provided on the display unit 202, which enables the entry of items or coordinate values on the display unit 202 by depressing its surface with a finger or the like.

204 is a FM (Frequency Modulation) sound source unit, which makes the FM modulation for the music information created with a music editor, this information being stored in a memory 210 or an external storage device 212 as the digital data and read therefrom for the FM modulation. An electrical signal from the FM sound source unit 204 is converted into an audible sound by a speaker unit 205. A printer unit 206 consists of a recording apparatus according to the present invention as the output terminal for a word processor, a personal computer, a facsimile apparatus, a copying machine or an electronic typewriter.

207 is an image reader unit for photoelectrically reading original data for the input, which is provided midway on original conveying passage to read facsimile or copying original, and other various kinds of originals. 208 is a FAX transmission or reception unit for FAX transmitting original data read by the image reader unit 207 or receiving and decoding the facsimile signal transmitted thereto, this unit having an interface facility with the outside. 209 is a telephone unit, comprising various telephone functions, such as an ordinary telephone function or an automatic answering telephone function. 210 is a memory unit comprised of a ROM for storing a system program, manager programs and other application programs, character fonts, and dictionaries, application programs or document information loaded from the external storage device 212, and a video RAM.

211 is a keyboard unit useful for inputting document information or various kinds of command. 212 is an external storage device, which is a storage medium consisting of a floppy disk or a hard disk, for the storage of document information, music or audio data, and user's application programs.

Figure 25:
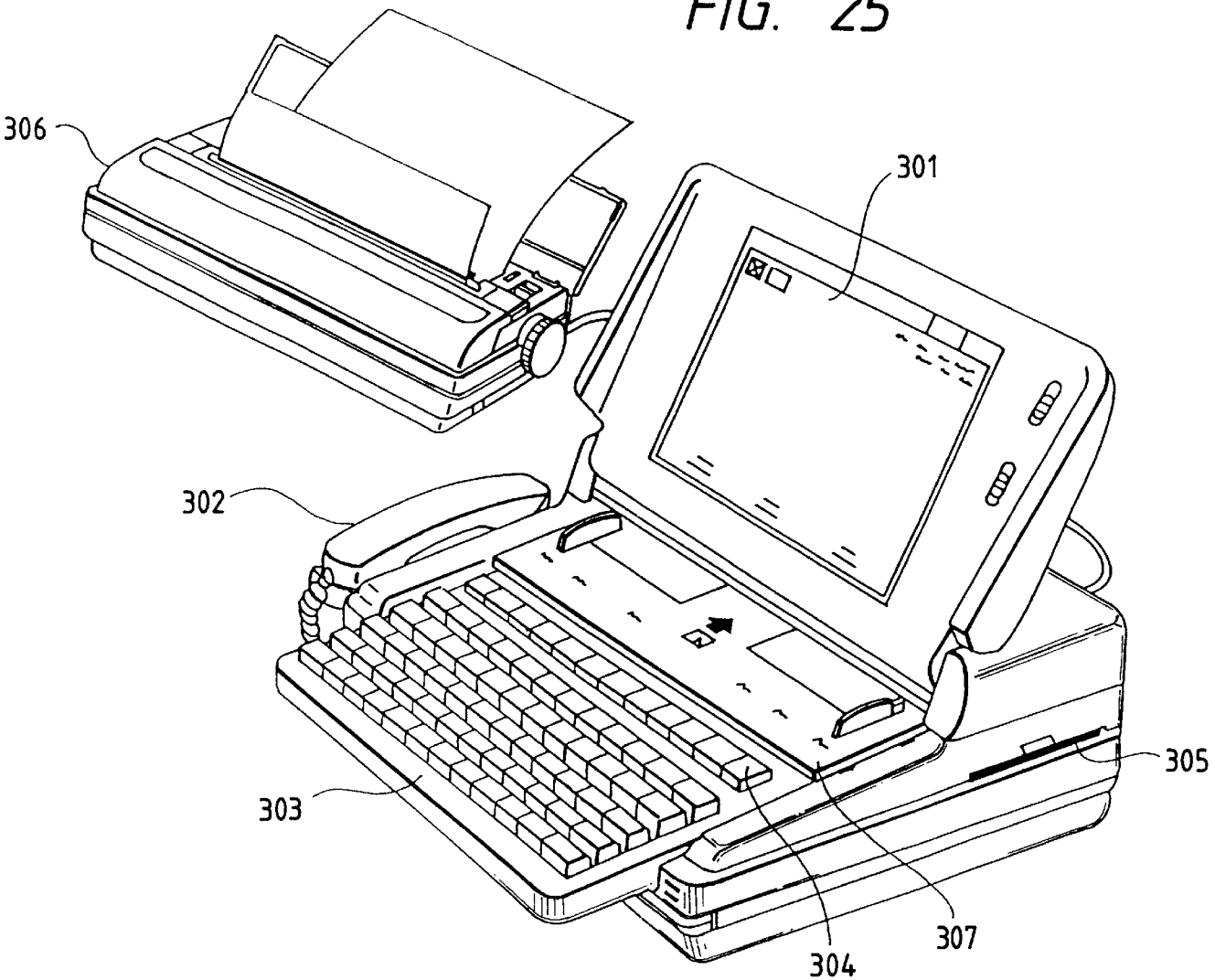
FIGS. 25 and 26 are external views of the information processing apparatus.

FIG. 25 is an appearance view of the information processing apparatus as shown in FIG. 24. In the figure, 301 is a flat panel display utilizing liquid crystal or the like for displaying varius menus, graphic data or documents. On this display 301 is installed a touch panel, which enables the entry of coordinates or item specifications by depressing the surface of the touch panel with a finger or the like. 302 is a handset for use when the apparatus functions as a telephone.

A keyboard 303 is detachably connected via a cord to the main body, and is used to input various documents or data. Also, the keyboard 303 is provided with various function keys 304. 305 is an opening for insertion of the floppy disk.

307 is a sheet setting board for placing thereon a paper to be read by the image reader unit 207, the read paper being exhausted out of the rear side of device. In the facsimile reception, received data is recorded by the printer.

It should be noted that the display unit 301 as above described may be a CRT, but is preferably a flat panel of the liquid crystal display using a ferroelectric liquid crystal, because it can be lighter as well as more compact and thinner. When the above-noted information processing device functions as a personal computer or a word processor, various kinds of document information input from the keyboard 211 are processed according to a predetermined program by the control unit 201 as shown in FIG. 24, and output as the image to the printer unit 206. When such information processing device functions as a receiver for the facsimile apparatus, facsimile information input from the FAX transmission/reception unit 208 via the communication line are received according to a predetermined program by the control unit 201, and output to the printer unit 206 as the received image.

Figure 26:
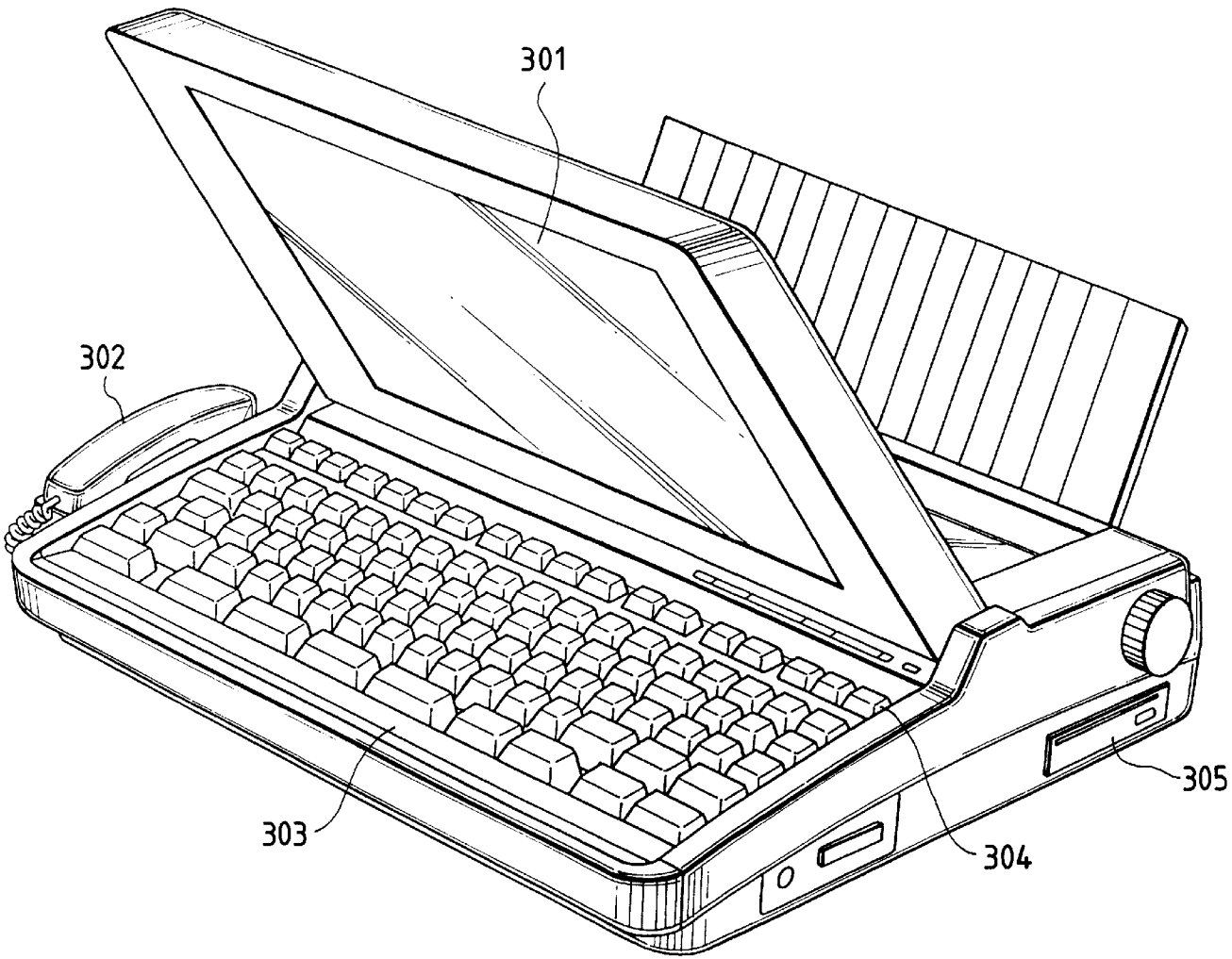

And when it functions as a copying machine, the original is read by the image reader unit 207, and read original data is output via the control unit 201 to the printer unit 206 as the copied image. Note that it functions as a transmitter for the facsimile apparatus, original data read by the image reader unit 207 is processed for transmission according to a predetermined program by the control unit 201, and transmitted via the FAX transmission/reception unit 208 to the communication line. It should be noted that the above-noted information processing device can be an integral type incorporating a printer within the main body, as shown in FIG. 26, in which its portability can be enhanced. In the same figure, corresponding reference numerals are affixed to the parts having the same functions as those in FIG. 25.

If a recording apparatus of the present invention is applied to the multifunctional type information processing device as above described, higher quality recording image can be obtained so that the functions of the information processing device can be further enhanced.

As above described, with the present invention, the image excellent in gradation and resolution and with reduced graininess can be obtained, and a compact, inexpensive ink jet recording apparatus can be provided.

Further, this recording apparatus can perform the recording without any decrease in the speed when recording the document, graphic and listing image.

What is claimed is:

1. An ink jet recording apparatus which records by discharging an ink onto a recording medium in accordance with a recording data, characterized by comprising:

a mounting portion for exchangeably mounting either a first recording means for discharging an ink of a predetermined color and having a single density and a second recording means for discharging an ink of the predetermined color and having a plurality of densities;

image processing means for processing image data corresponding to an image to be recorded, the image processing means forming driving data for controlling driving of said recording means to control a discharge of ink based on a density which image data indicates, the image processing means selectively utilizing a first table for converting image data into image data corresponding to an ink having a predetermined single density and a second table for converting image data into image data corresponding to each of inks having a plurality of densities, and the image processing means forming driving data for discharging ink based on converted image data;

means for receiving designated information, indicating whether the first recording means or the second recording means is mounted in the mounting means, for instructing said image processing means; and recording control changing means for changing a table for converting image data to be utilized by said image processing means based on said designated information.

2. An ink jet recording apparatus according to claim 1, wherein said first recording means and said second recording means each have a discharge orifice array comprising a plurality of discharge orifices.

3. An ink jet recording apparatus according to claim 2, wherein said second recording means has said discharge orifices disposed in a plurality of sections, corresponding to said plurality of densities.

4. An ink jet recording apparatus according to claim 1, wherein said first recording means and said second recording means each have a discriminated element which is discriminated by said discriminating means.

5. An ink jet recording apparatus according to claim 4, wherein said discriminated means is a plurality of pin members provided at contact points when said first recording means and said second recording means are mounted on said mounting portion.

6. An ink jet recording apparatus according to claim 4, wherein said discriminated means is of a type which is electrically conductive or non-electrically conductive member, and said discriminating means discriminates the type of said recording means by detecting a conductivity of said discriminated means.

7. An ink jet recording apparatus according to claim 1, further comprising:

ink supply means for supplying the inks to be exchangeably mounted on said mounting portion in accordance with a type of said particular recording means mounted on said mounting portion;

wherein said discriminating means makes a discrimination whether said particular recording means to be mounted on said mounting portion is said first recording means or said second recording means by detecting a type of said ink supply means.

8. An ink jet recording apparatus according to claim 7, wherein said ink supply means has a discriminated element in accordance with the type of a corresponding said recording means, and said discriminated element is discriminated by said discriminating means.

9. An ink jet recording apparatus according to claim 8, wherein said discriminated means is a marking in accordance with corresponding recording means.

10. An ink jet recording apparatus according to claim 1, wherein said particular recording means has heat energy generating means for giving heat energy to the ink, and discharges the ink using that heat energy.

11. An ink jet recording apparatus according to claim 10, wherein said particular recording means causes a state change in the ink by using heat energy generated by said heat energy generating means, and discharges the ink in response to a pressure produced by said state change.

12. An ink jet recording apparatus according to claim 1, further comprising reading means for reading an original image to be recorded on the recording medium.

13. An ink jet recording apparatus according to claim 1, further comprising image information handing means for at least one of transmitting and receiving image information.

14. An image recording apparatus according to claim 13, further comprising reading means for reading an original image to be recorded on the recording medium.

15. An image recording apparatus according to claim 1, further comprising input means for inputting record data to be recorded on the recording medium.

16. An ink jet recording apparatus according to claim 15, wherein said input means is a keyboard.

17. An ink jet recording apparatus as in claim 1, wherein said first recording means and said second recording means each can discharge a plurality of different color inks.

18. An ink jet recording apparatus which records by discharging an ink onto a recording medium in accordance with a recording data and a system comprising a host device connected to said ink jet recording apparatus, said apparatus comprising:

information generating means for generating information signifying whether a particular recording means mounted on said mounting portion is a first recording means or a second recording means, said information generating means being provided in said host device;

a mounting portion for exchangeably mounting either the first recording means for discharging an ink of a predetermined color and having a single density and the second recording means for discharging an ink of the predetermined color and having a plurality of densities;

image processing means for processing image data corresponding to an image to be recorded, the image processing means forming driving data for controlling driving of said recording means to control a discharge of ink based on a density which image data indicates, the image processing means selectively utilizing a first table for converting image data into image data corresponding to an ink having a predetermined single density and a second table for converting image data into image data corresponding to each of inks having a plurality of densities, and the image processing means forming driving data for discharging ink based on converted image data; and recording control changing means for changing a table for converting image data to be utilized by said image processing means based on said generated information.

19. An ink jet recording apparatus according to claim 18, wherein said first recording means and said second recording means each have a discharge orifice array comprising a plurality of discharge orifices.

20. An ink jet recording apparatus according to claim 19, wherein said second recording means has said discharge orifices disposed in a plurality of sections, corresponding to said plurality of densities.

21. An ink jet recording apparatus according to claim 18, wherein said information generating means is a dip switch provided on the ink jet recording apparatus.

22. An ink jet recording apparatus according to claim 18, wherein said information generating means is an operation panel provided on the ink jet recording apparatus.

23. An ink jet recording apparatus according to claim 18, wherein said information generating means generates said information based on an instruction from host means connected to the ink jet recording apparatus.

24. An ink jet recording apparatus according to claim 18, wherein said particular recording means has heat energy generating means for supplying heat energy to the ink, and discharges the ink using that heat energy.

25. An ink jet recording apparatus according to claim 24, wherein said particular recording means causes a state change in the ink by using heat energy generated by said heat energy generating means, and discharges the ink in response to a pressure produced by said state change.

26. An ink jet recording apparatus as in claim 18, wherein said first recording means and said second recording means each can discharge a plurality of different color inks.

27. An ink jet recording method for recording by discharging an ink onto a recording medium in accordance with a recording data using a particular recording means for recording mounted on a mounting portion for exchangeably mounting either a first recording means for discharging an ink of a predetermined color and having a single density or a second recording means for discharging an ink of the predetermined color and having a plurality of densities, characterized by including:

a step of receiving designated information, indicating whether the first recording means of the second recording means is mounted in the mounting portion, for instructing recording control;

a recording control changing step of changing a recording control of the recording in accordance with said designated information; and image processing steps for processing image data corresponding to an image to be recorded, the image processing steps forming driving data for controlling driving of said recording means to control a discharge of ink based on a density which image data indicates, the image processing steps selectively utilizing a first table for converting image data into image data corresponding to an ink having a predetermined single density and a second table for converting image data into image data corresponding to each of inks having a plurality of densities, and the image processing steps forming driving data for discharging ink based on converted image data, and wherein said recording control changing step changes a table for converting image data to be utilized by said image processing step based on said designated information.

28. An ink jet recording method according to claim 27, wherein said first recording means and said second recording means each have a discriminated element which is discriminated in said discrimination step.

29. An ink jet recording method according to claim 27, wherein an ink supply means for supplying the inks is exchangeably mounted on said mounting portion in accordance with a type of said particular recording means to be mounted on said mounting portion, and said discrimination step makes a discrimination as to whether said particular recording means to be mounted on said mounting portion is said first recording means or said second recording means by detecting a type of said ink supply means.

30. An ink jet recording method according to claim 29, wherein said ink supply means has a discriminated marking in accordance with the type of a corresponding said recording means, and said discriminated marking is discriminated in said discrimination step.

31. An ink jet recording method according to claim 27, wherein said particular recording means has heat energy generating means for supplying heat energy to the ink, and discharges the ink using said heat energy.

32. An ink jet recording method according to claim 31, wherein said particular recording means causes a state change in the ink using heat energy generated by said heat energy generating means, and discharges the ink in response to a pressure produced by said state change.

33. An ink jet recording method as in claim 27, wherein said first recording means and said second recording means each can discharge a plurality of different color inks.

34. An ink jet recording method for recording by discharging an ink onto a recording medium in accordance with a recording data using a particular recording means mounted on a mounting portion for exchangeably mounting either a first recording means for discharging or a second recording means for discharging an ink of the predetermined color and having a plurality of densities, said recording method comprising the steps of:

providing a recording system comprising a host device connected to said ink jet recording apparatus;

a generating step for generating designated information for instructing recording control by said host device;

a recording control changing step of changing a recording control in accordance with the information of said information generating step; and image processing steps for processing image data corresponding to an image to be recorded, the image processing steps forming driving data for controlling driving of said recording means to control a discharge of ink based on a density which image data indicates, the image processing steps selectively utilizing a first table for converting image data into image data corresponding to an ink having a predetermined single density and a second table for converting image data into image data corresponding to each of inks having a plurality of densities, and the image processing steps forming driving data for discharging ink based on converted image data, wherein said recording control changing step changes a table for converting image data to be utilized by said image processing step based on said generated information.

35. An ink jet recording apparatus which performs the recording by discharging ink onto a recording medium in accordance with recording data, comprising:

a mounting portion for exchangeably mounting a recording means, the mounting portion being adjusting to selectively mount recording means among a plurality of recording means, each discharging a different kind of ink;

discriminating means for discriminating the recording means mounted on said mounting portion; and controlling means or executing control in such a manner that an image processing corresponding to a gradation value of image data of a predetermined color in a case where, with respect to a predetermined color, recording can be made by an ink having a single density is differentiated from that in a case where, with respect to a predetermined color, recording can be made by inks having a plurality of different densities, based on a discriminated result by said discriminating means.

36. A controlling method in an ink jet recording apparatus which performs the recording by discharging ink onto a recording medium in accordance with recording data, said apparatus having a mounting portion for exchangeably mounting a recording means, the method comprising the steps of:

a discriminating step for discriminating the recording means mounted on said mounting portion; and an image processing step for executing a process of image data, wherein, in said image processing step, an image processing corresponding to a gradation value of image data of a predetermined color in a case where, with respect to a predetermined color, recording can be made by an ink of a single density is differentiated from that in a case where, with respect to a predetermined color, recording can be made by inks having a plurality of different densities, based on a discriminated result by said discriminating means.

* * * * *

UNITED STATES PATENT AND TRADEMARK OFFICE

CERTIFICATE OF CORRECTION

PATENT NO. : 6,132,022
DATED : October 17, 2000
INVENTOR(S) : Yuji Akiyama, et al.

It is certified that error appears in the above-identified patent and that said Letters Patent is hereby corrected as shown below:

On the title page.
Under[57] Abstract, line 4, "to the" should read --to be--.

COLUMN 4

Line 50, "looked" should read --viewed--;
Line 53, "looked" should read --viewed--;
Line 61, "appa" should read --main apparatus.--; and
Line 62, "ratus main." should be deleted.

COLUMN 5

Line 16, "looked" should read --viewed--.

COLUMN 7

Line 50, "Carraige 51" should read --Carriage 51--.

COLUMN 8

Line 42, "has" should read --is--.

UNITED STATES PATENT AND TRADEMARK OFFICE

CERTIFICATE OF CORRECTION

PATENT NO. : 6,132,022

DATED : October 17, 2000

INVENTOR(S) : YUJI AKIYAMA, et al.

It is certified that error appears in the above-identified patent and that said Letters Patent is hereby corrected as shown below:

COLUMN 9

Line 2, "top 62" should read --top 64--;
Line 15, "looked" should read --viewed--;
Line 24, "looked" should read --viewed--; and
Line 40, "looked" should read --viewed--.

COLUMN 10

Line 3, "is" should read --does--;
Line 4, "and" should read --and is--;
Line 14, "(N+1)th line and at the (N+1)th" should read --(N+2)th line and at the (N+3)th--;
Line 20, "apparatus main," should read --main apparatus,--;
Line 28, "apparatus main" should read --main apparatus--;
Line 36, "The" should read --The main--; and
Line 37, "main" should be deleted.

UNITED STATES PATENT AND TRADEMARK OFFICE

CERTIFICATE OF CORRECTION

PATENT NO. : 6,132,022

DATED : October 17, 2000

INVENTOR(S) : YUJI AKIYAMA, et al.

It is certified that error appears in the above-identified patent and that said Letters Patent is hereby corrected as shown below:

COLUMN 11

Line 23, "apparatus main" should read --main apparatus--;
Line 33, "An ink tank 160" should read --Ink tanks 160Y, 160M, 160C, and 160K--;
Line 34, "is" should read --are each--;
Line 36, "An ink tank 180" should read ----Ink tanks 180Y, 180M, 180C, and 180K--;
Line 36, "has" should read --have--;
Line 55, "apparatus main" should read --main apparatus--; and
Line 63, "apparatus main" should read --main apparatus--.

COLUMN 12

Line 21, "This" should read --These--;
Line 28, "looked" should read --viewed--; and
Line 63, "an" should read --a--.

COLUMN 14

Line 11, "(ink.)," should read --(ink),--.

COLUMN 16

Line 13, "varius" should read --various--.

UNITED STATES PATENT AND TRADEMARK OFFICE

CERTIFICATE OF CORRECTION

PATENT NO. : 6,132,022

DATED : October 17, 2000

INVENTOR(S) : YUJI AKIYAMA, et al.

It is certified that error appears in the above-identified patent and that said Letters Patent is hereby corrected as shown below:

COLUMN 18

Line 19, "handing" should read --handling--.

COLUMN 19

Line 36, "of" should read --or--.

COLUMN 20

Line 61, "adjusting" should read --adjusted--.

Signed and Sealed this

First Day of May, 2001

*Attest:*

Nicholas P. Godici

NICHOLAS P. GODICI

*Attesting Officer*

*Acting Director of the United States Patent and Trademark Office*